US008322585B2

(12) United States Patent
Herron et al.

(10) Patent No.: US 8,322,585 B2
(45) Date of Patent: Dec. 4, 2012

(54) GOLF BAG OR OTHER SHOULDER-BORNE DEVICE HAVING DOUBLE STRAP TO SINGLE STRAP CONVERTIBILITY

(75) Inventors: Heather L. Herron, Portland, OR (US); Jeffrey W. Wear, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 686 days.

(21) Appl. No.: 12/474,011

(22) Filed: May 28, 2009

(65) Prior Publication Data

US 2010/0301086 A1 Dec. 2, 2010

(51) Int. Cl.
*A45C 15/00* (2006.01)

(52) U.S. Cl. ..... 224/576; 224/579; 224/627; 224/608; 224/259; 206/315.7

(58) Field of Classification Search ..... 224/645, 224/608, 614, 600, 606, 607, 613, 627, 259, 224/576, 578–580; 206/315.3, 315.7, 315.8
See application file for complete search history.

(56) References Cited

U.S. PATENT DOCUMENTS

| | | | | |
|---|---|---|---|---|
| 1,444,157 A | | 2/1923 | Lee | |
| 2,820,498 A | * | 1/1958 | Endee | 224/608 |
| 4,887,751 A | * | 12/1989 | Lehman | 224/579 |
| 5,038,984 A | | 8/1991 | Izzo | |
| 5,042,703 A | * | 8/1991 | Izzo | 224/643 |
| 5,042,704 A | * | 8/1991 | Izzo | 224/643 |
| 5,294,183 A | | 3/1994 | Wetter et al. | |
| 5,319,836 A | | 6/1994 | Ida | |
| 5,348,205 A | * | 9/1994 | Steurer | 224/627 |
| 5,361,957 A | | 11/1994 | Weintraub | |
| 5,419,473 A | * | 5/1995 | Lamar | 224/632 |
| 5,435,647 A | | 7/1995 | Oliver | |
| 5,558,259 A | | 9/1996 | Izzo | |
| 5,593,077 A | | 1/1997 | Izzo | |

(Continued)

FOREIGN PATENT DOCUMENTS

EP 0 898 906 A2 3/1999

(Continued)

OTHER PUBLICATIONS

International Search Report and Written Opinion issued in corresponding PCT Application, International Application No. PCT/US2010/030963 on Jul. 2, 2010.

(Continued)

*Primary Examiner* — Justin Larson
*Assistant Examiner* — Peter Helvey
(74) *Attorney, Agent, or Firm* — Banner & Witcoff, Ltd.

(57) ABSTRACT

Golf bags and other shoulder borne devices have strapping systems capable of converting between a single strap configuration and a double strap configuration. The strapping system includes two main straps. In the double strap configuration, the first strap member has three ends, each of which is attached to a location on the golf bag (or other structure), and the second strap member has one free end attached to the golf bag (or other structure) and one free end attached to a central area of the first strap member. When converting to the single strap configuration, the first strap member is removed from the golf bag (or other structure) completely, and the free end of the second strap member that was attached to the first strap member is removed therefrom and engaged with the golf bag (or other structure).

26 Claims, 16 Drawing Sheets

U.S. PATENT DOCUMENTS

| | | | | |
|---|---|---|---|---|
| 5,636,778 | A | 6/1997 | Jones et al. | |
| 5,860,769 | A | 1/1999 | Seligman | |
| D409,838 | S * | 5/1999 | Steurer | D3/327 |
| 5,954,254 | A * | 9/1999 | Maeng | 224/645 |
| 5,954,255 | A * | 9/1999 | Beebe et al. | 224/645 |
| D415,351 | S * | 10/1999 | Wang | D3/327 |
| 5,988,475 | A | 11/1999 | Han | |
| 6,006,974 | A | 12/1999 | Varney et al. | |
| D419,294 | S * | 1/2000 | Wang | D3/255 |
| 6,109,495 | A | 8/2000 | Hernandez | |
| 6,131,783 | A * | 10/2000 | Maeng | 224/645 |
| 6,152,342 | A | 11/2000 | Suk | |
| 6,152,343 | A | 11/2000 | Shin | |
| 6,168,060 | B1 | 1/2001 | Mayers | |
| 6,223,959 | B1 | 5/2001 | Chen | |
| 6,305,535 | B1 * | 10/2001 | Fair | 206/315.3 |
| 6,311,884 | B1 | 11/2001 | Johnson | |
| 6,457,620 | B1 | 10/2002 | Batten et al. | |
| 6,460,747 | B1 * | 10/2002 | Tuerschmann et al. | 224/645 |
| 6,471,105 | B1 | 10/2002 | Ammerman et al. | |
| 6,530,129 | B1 * | 3/2003 | Cheng | 24/200 |
| 6,915,932 | B1 | 7/2005 | Wolfe | |
| 7,198,183 | B2 | 4/2007 | Yang | |
| 7,387,226 | B2 * | 6/2008 | Porter | 224/259 |
| 7,448,522 | B2 | 11/2008 | Collier et al. | |
| 2001/0015365 | A1 * | 8/2001 | Flynn | 224/259 |
| 2002/0088836 | A1 | 7/2002 | Batten et al. | |
| 2003/0121942 | A1 | 7/2003 | Chang | |
| 2004/0206793 | A2 | 10/2004 | Enes | |
| 2005/0279795 | A1 | 12/2005 | Campbell et al. | |
| 2008/0164165 | A1 * | 7/2008 | McGuire et al. | 206/315.3 |

FOREIGN PATENT DOCUMENTS

| | | | |
|---|---|---|---|
| FR | 2 406 402 | | 10/1978 |
| FR | 2819192 | A1 | 7/2002 |
| GB | 2 328 604 | A | 3/1999 |
| WO | 98/17144 | | 4/1998 |
| WO | 01/50909 | A1 | 7/2001 |

OTHER PUBLICATIONS

Internet Printout: http://www.teetogreendiscountgolf.com/Accessories/dualstrapbag.htm, Izzo Dual Strap Bag, dated May 19, 2004.

Internet Printout: http://www.golfdiscount.com/Detail.bok?searchpath, Ladies' Superlight 3.5 Dual-Strap Stand Bag, dated May 19, 2004.

* cited by examiner

GOLF BAG OR OTHER SHOULDER-BORNE DEVICE HAVING DOUBLE STRAP TO SINGLE STRAP CONVERTIBILITY

FIELD OF THE INVENTION

The present invention relates to golf bags including strap systems that are convertible between a single strap configuration and a double strap configuration, as well as to the strapping systems themselves and the methods of converting between the double and single strap configurations. Aspects and features of this invention may be useful for other devices carried by shoulder-borne strapping systems, such as backpacks, luggage, briefcases, purses, etc.

BACKGROUND OF THE INVENTION

Golf bags come in many different sizes and configurations. There are relatively large and heavy bags, such as those that are typically used by professional players and/or those typically secured to a riding cart, a pull cart, or other type of carrier. These bags typically have numerous pockets and are able to contain many items in addition to the golf clubs themselves. There are also relatively small and lightweight bags that are typically used by players that prefer to carry their clubs as they walk the course and play golf. Golf bags also come in a wide variety of sizes and configurations between these extremes.

A variety of carry strap systems are available for golf bags. Some carry strap systems provide a single strap for carrying the bag over a single shoulder. Such straps can be somewhat difficult and tiresome to use, particularly for heavy bags and/or for carrying bags over long distances. Accordingly, some users prefer golf bag strap systems that have a double strap that allows the bag to be carried over both shoulders. While useful to more evenly divide and orient the load when carrying a bag, such strap systems can be cumbersome to put on, bulky, and somewhat difficult to use. Moreover, golfers tend to have a distinct preference as to the type of strapping system they prefer to use, a single strap or a double strap, but this preference may change, depending on various factors, such as whether the golfer is walking, riding in a cart, using a pull cart, carrying the bag, using a caddy, etc.

When walking and carrying their bags, many golfers prefer to use the dual strap system because this better distributes and orients the weight and prevents fatigue on a single shoulder or side over the course of an 18 hole round. Caddies at many golf courses, however, prefer to use a single strap configuration because in that manner they can simultaneously carry bags for two players. Trying to carry a bag having a double shoulder strap over a single shoulder can be inconvenient and uncomfortable because the double strap arrangement does not necessarily fit well over a single shoulder and because the excess strap remains loose, which can become a nuisance or pose a tripping hazard.

Accordingly, there is a need in the art for a simple, easy to use, and convenient strapping system that is convertible between a single strap configuration and a double strap configuration.

BRIEF SUMMARY OF THE INVENTION

Various aspects of this invention relate to golf bag structures that have the capability of converting between a single strap configuration and a double strap configuration. As some more specific examples, golf bag structures in accordance with at least some examples of this invention include: (a) a body member having an open first end for receiving one or more golf clubs and a closed second end, wherein the body member extends in a longitudinal direction from the first end to the second end, and wherein the body member defines an overall height dimension extending in the longitudinal direction; (b) at least four strap connection structures engaged with the body member (and in some examples, at least five strap connection structures and even at least six strap connection structures), each strap connection structure for releasably engaging a strap connector; and (c) a strap system including a first strap member and a second strap member for releasably engaging the body member at a plurality of the strap connection structures. At least two of the strap connection structures will be provided proximate to the open end of the golf bag and at least two of the strap connection structures will be provided at locations away from the open end, e.g., at or near the bag's center in the longitudinal direction.

In the double strap configuration, the first strap member will connect at three of the strap connection structures, and the second strap member will connect to the first strap member and to one of the strap connection structures on the bag member. To convert to the single strap configuration, the first strap member is disconnected from the bag body member; the second strap member is disconnected from the first strap member and connected to the body member near its top; and, optionally, the other end of the second strap member may be moved to a different strap connection structure on the body member. As another alternative, rather than moving the second strap member to a different strap connection structure, the strap connection structure on which the second strap member is engaged may be moved with respect to the bag's body member, if necessary, to provide a more balanced and comfortable strap connection configuration for the user.

In the single strap configuration, the second strap member will connect at two of the strap connection structures, one at the top and one longitudinally downward from the top, and the first strap member will be disconnected from the body member. To convert to the double strap configuration, one end of the second strap member is disconnected from its strap connection structure and is connected to a base portion of the first strap member; optionally, the second end of the second strap member may be moved to a different strap connection structure (or the strap connection structure to which it is connected may be moved to a different position); and the three strap connectors on the first strap member are engaged with three strap connection structures provided on the body member.

Additional aspects of this invention relate to strap systems that may be used in the golf bags and methods described above. Still additional aspects and features of this invention may be useful for other devices carried by shoulder-borne strapping systems, such as backpacks, luggage, briefcases, purses, etc.

BRIEF DESCRIPTION OF THE DRAWINGS

The above-noted and other features and aspects of the invention will become more apparent from the following detailed description, when considered in conjunction with the appended drawings, wherein:

FIGS. 10A through 12B illustrate various examples of movable strap connection structures in accordance with this invention.

DETAILED DESCRIPTION OF THE INVENTION

Figure 1:
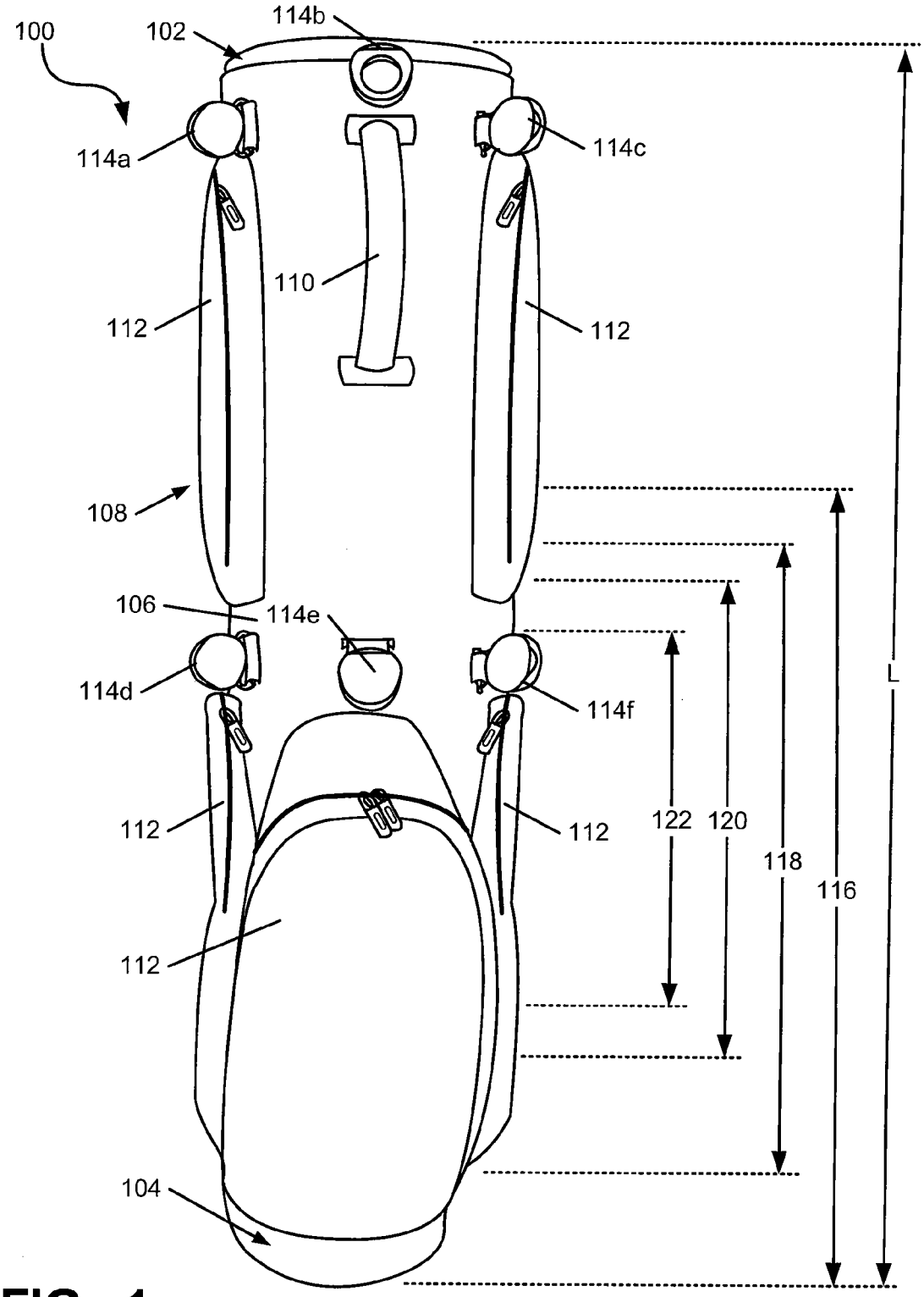
FIG. 1 illustrates one example golf bag structure in accordance with this invention.

I. General Description of Golf Bags and Strap Constructions According to Examples of this Invention In general, as described above, some aspects of this invention relate to golf bag structures (or other shoulder-borne articles) that have the capability of converting between a single strap configuration and a double strap configuration, as well as to strap systems useful in making these conversions and to methods of making these conversions.

As some more specific examples, aspects of this invention relate to golf bags that include: (a) a body member constructed from one or more parts and including an open first end for receiving one or more golf clubs and a closed second end, wherein the body member extends in a longitudinal direction from the first end to the second end, and wherein the body member defines an overall height dimension extending in the longitudinal direction; (b) a plurality of strap connection structures engaged with the body member, each strap connection structure for releasably engaging a strap connector; and (c) a strap system including a first strap member and a second strap member for releasably engaging the body member at a plurality of the strap connection structures, wherein the strap system is convertible between a double strap configuration and a single strap configuration. Various example connection arrangements are possible in accordance with various examples of this invention, and several of these arrangements will be described in more detail below.

In some example bag structures in accordance with this invention, at least six strap connection structures will be provided, three located proximate to the open first end and three located downward from the open first end (e.g., at least 40% of the overall longitudinal height downward from the open first end, and in some examples, between 40-75% of the overall longitudinal height downward, or even between 40-60% of the height). The various strap connection structures are circumferentially spaced around the bag's body member. In one example structure, when in the double strap configuration, the strap system will be engaged with the body member as follows: (a) a first strap connector of the first strap member is releasably engaged with a top, outside strap connection structure, (b) a second strap connector of the first strap member is releasably engaged with the other top, outside strap connection structure, (c) a third strap connector of the first strap member is releasably engaged with a lower, outside strap connection structure, (d) a first strap connector of the second strap member is releasably engaged with the other lower, outside strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with the lower, center strap connection structure, (b) the second strap connector of the second strap member is releasably engaged with the upper, center strap connection structure, and (c) the first strap member is not engaged with any of the first through sixth strap connection structures.

In another example arrangement having at least six strap connection structures as described above, in the double strap configuration, the strap system may be engaged with the body member as follows: (a) a first strap connector of the first strap member is releasably engaged with a top, outside strap connection structure, (b) a second strap connector of the first strap member is releasably engaged with a lower, outside strap connection structure, (c) a third strap connector of the first strap member is releasably engaged with the other lower, outside strap connection structure, (d) a first strap connector of the second strap member is releasably engaged with the other top, outside strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with the lower, center strap connection structure, (b) the second strap connector of the second strap member is releasably engaged with the upper, center strap connection structure, and (c) the first strap member is not engaged with any of the first through sixth strap connection structures.

In some example bag structures in accordance with this invention, at least five strap connection structures will be provided, three located proximate to the open first end and two located downward from the open first end (e.g., at least 40% of the overall longitudinal height downward from the open first end, and in some examples, between 40-75% of the overall longitudinal height downward, or even between 40-60% of the height). The various strap connection structures are circumferentially spaced around the bag's body member from one another. In one example structure, when in the double strap configuration, the strap system will be engaged with the body member as follows: (a) a first strap connector of the first strap member is releasably engaged with a top, outside strap connection structure, (b) a second strap connector of the first strap member is releasably engaged with the other top, outside strap connection structure, (c) a third strap connector of the first strap member is releasably engaged with a lower strap connection structure, (d) a first strap connector of the second strap member is releasably engaged with the other lower strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with one of the lower strap connection structures, (b) the second strap connector of the second strap member is releasably engaged with the top, center strap connection structure, and (c) the first strap member is not engaged with any of the first through fifth strap connection structures.

In another example arrangement having at least five strap connection structures as described in the preceding paragraph, in the double strap configuration, the strap system may be engaged with the body member as follows: (a) a first strap connector of the first strap member is releasably engaged with a top, outside strap connection structure, (b) a second strap connector of the first strap member is releasably engaged with a lower strap connection structure, (c) a third strap connector of the first strap member is releasably engaged with the other lower strap connection structure, (d) a first strap connector of the second strap member is releasably engaged with the other top, outside strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with a lower strap connection structure, (b) the second strap connector of the second strap member is releasably engaged with the top, center strap connection structure, and (c) the first strap member is not engaged with any of the first through fifth strap connection structures.

Other example bag structures in accordance with this invention may include at least five strap connection structures, but with two located proximate to the open first end and three located downward from the open first end (e.g., at least 40% of the overall longitudinal height downward from the open first end, and in some examples, between 40-75% of the overall longitudinal height downward, or even between 40-60% of the height). The various strap connection structures are circumferentially spaced around the bag's body member from one another. In one example structure, when in the double strap configuration, the strap system will be engaged with the body member as follows: (a) a first strap connector of the first strap member is releasably engaged with a top strap connection structure, (b) a second strap connector of the first strap member is releasably engaged with the other top strap connection structure, (c) a third strap connector of the first strap member is releasably engaged with a lower, outside strap connection structure, (d) a first strap connector of the second strap member is releasably engaged with the other lower, outside strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with the lower, center strap connection structure, (b) the second strap connector of the second strap member is releasably engaged with one of the top strap connection structures, and (c) the first strap member is not engaged with any of the first through fifth strap connection structures.

In another example arrangement having at least five strap connection structures as described in the preceding paragraph, in the double strap configuration, the strap system may be engaged with the body member as follows: (a) a first strap connector of the first strap member is releasably engaged with a top strap connection structure, (b) a second strap connector of the first strap member is releasably engaged with a lower, outside strap connection structure, (c) a third strap connector of the first strap member is releasably engaged with the other lower, outside strap connection structure, (d) a first strap connector of the second strap member is releasably engaged with the other top strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with the lower, center strap connection structure, (b) the second strap connector of the second strap member is releasably engaged with one of the top strap connection structures, and (c) the first strap member is not engaged with any of the first through fifth strap connection structures.

In some example bag structures in accordance with this invention, at least four strap connection structures will be provided, two located proximate to the open first end and two located downward from the open first end (e.g., at least 40% of the overall longitudinal height downward from the open first end, and in some examples, between 40-75% of the overall longitudinal height downward, or even between 40-60% of the height). The various strap connection structures are circumferentially spaced around the bag's body member from one another. In one example structure, when in the double strap configuration, the strap system will be engaged with the body member as follows: (a) a first strap connector of the first strap member is releasably engaged with a top strap connection structure, (b) a second strap connector of the first strap member is releasably engaged with the other top strap connection structure, (c) a third strap connector of the first strap member is releasably engaged with a lower strap connection structure, (d) a first strap connector of the second strap member is releasably engaged with the other lower strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with one of the lower strap connection structures, (b) the second strap connector of the second strap member is releasably engaged with one of the top strap connection structures, and (c) the first strap member is not engaged with any of the first through fourth strap connection structures.

In another example arrangement having at least four strap connection structures as described in the preceding paragraph, in the double strap configuration, the strap system may be engaged with the body member as follows: (a) a first strap connector of the first strap member is releasably engaged with a top strap connection structure, (b) a second strap connector of the first strap member is releasably engaged with a lower strap connection structure, (c) a third strap connector of the first strap member is releasably engaged with the other lower strap connection structure, (d) a first strap connector of the second strap member is releasably engaged with the other top strap connection structure, and (e) a second strap connector of the second strap member is releasably engaged with a base portion of the first strap member. When in the single strap configuration, the strap system of this example structure is engaged with the body member as follows: (a) the first strap connector of the second strap member is releasably engaged with a lower strap connection structure, (b) the second strap connector of the second strap member is releasably engaged with a top strap connection structure, and (c) the first strap member is not engaged with any of the first through fourth strap connection structures.

In any of the bag structures described above, one or more of the strap connection structures may be movably mounted with respect to the bag, e.g., so that the connection location may be moved in the circumferential direction around the bag, in the longitudinal direction, or in any other desired direction or combination of directions. The strap connection structures and/or the strap connectors may be coded in some manner so as to enable users to easily determine proper strap locations and orientations when switching from one configuration to the other.

Given this general description of various features and aspects of the invention, a more detailed description of specific examples of this invention will be provided below. This more detailed description should be considered as describing examples of the invention and not as limiting the invention.

II. Detailed Description of Specific Example Golf Bag and Strap Systems Constructions According to this Invention FIG. 1 illustrates an example golf bag 100 that may include various features and aspects of this invention. The bag 100 includes an open top end 102, a closed bottom end 104 (which may include a rigid base or stand to help the bag reliably stand up), and one or more sidewalls 106 that extend between the top end 102 and the bottom end 104 to define an overall body member 108 for the golf bag structure 100. Any number of parts may be used to build the golf bag structure 100, and the structure 100 may include various features, such as a handle member 110, one or more pockets 112, an externally accessible ball holder, a separate putter holder, dividers extending at least some portion between the top end 102 and the bottom end 104, hardware attachment elements (e.g., for engaging a towel, club cleaner, etc.), snap fittings (e.g., for engaging a cover member, etc.), stand legs, stand leg extension and/or retraction mechanisms, and/or other features, including features that are conventionally known and used in the art. The bag structure 100 defines a longitudinal direction L extending in the vertical direction from the open top end 102 to the closed bottom end 104 when the bag 100 is standing upright on its bottom end 104 (e.g., as shown in FIG. 1).

In this illustrated example golf bag structure 100, six strap connection structures 114*a* through 114*f* are provided. Three of the strap connection structures 114*a* through 114*c* are provided proximate the open top end 102, circumferentially disposed from one another on one circumferential half of the bag's body member 108. In this illustrated example, the strap connection structures 114*a* through 114*c* are centered on the front half of the bag's circumference, and optionally may be centered on the front one-third or even on the front one-fourth or one-fifth of the bag's circumference (e.g., centered with respect to a longitudinal line L extending from the bag's top end 102 to the bottom end 104 through the central, front located handle 110 in this illustrated example structure 100). The term "proximate," as used herein in this context, means that at least some portion of the attachment between the strap connection structure 114 and the body member 108 is located within 15% of the overall longitudinal length L from the top end 102 of the bag 100. In some examples structures 100, at least some portion of the attachment between the upper strap connection structures 114*a* through 114*c* and the body member 108 will be located within the upper 10% of the overall longitudinal length L of the bag structure 100. For movable strap connection structures, as described in more detail below, the strap connection structure is considered to be located "proximate" to the top of the bag 100 if at least a portion of the securing structure is capable of being positioned and secured at least partially within the positions described above.

The other three of the strap connection structures 114*d* through 114*f* are provided longitudinally downward from the top strap connection structures 114*a* through 114*c* and toward the bottom end 104 of the bag 100. While the lower strap connection structures 114*d* through 114*e* may be located at any desired longitudinal position on the bag structure, in accordance with at least some examples of this invention, at least some portion of the attachment between these lower strap connection structures and the body member 108 will be located at least 35% of the longitudinal length L downward from the top end 102 (range 116 in FIG. 1), and in some examples, at least some portion of the attachment between the lower strap connection structures 114*d* through 114*f* and the body member 108 may be located between 40% and 90% of the longitudinal length L (range 118 in FIG. 1), between 45% and 80% of the longitudinal length L (range 120 in FIG. 1), and in some examples between 50 and 75% of the longitudinal length L (range 122 in FIG. 1). The lower strap connection structures 114*d* through 114*f* are circumferentially disposed from one another on one circumferential half of the bag's body member 108. In this illustrated example, the strap connection structures 114*d* through 114*f* are centered on the front half of the bag's circumference, and optionally may be centered on the front one-third or even on the front one-fourth or one-fifth of the bag's circumference (e.g., with respect to a longitudinal line L extending from the bag's top end 102 to the bottom end 104 through the central, front located handle 110 in this illustrated example structure 100). The attachment locations of each of the lower strap connection structures 114*d* through 114*f* with the body member 108 may be located substantially vertically downward from the corresponding attachment locations for the upper strap connection structure 114*a* through 114*c* with the body member 108. In some example structures 100, the angle between at least some portion of the attachment location of an upper strap connection structure and at least some portion of the attachment location of its corresponding lower strap connection structure may be 0° (i.e., vertical) when the bag is oriented in its upright position and standing on base 104, as shown in FIG. 1, or within 10 degrees of vertical, or even within 5 degrees of vertical, in some examples. Strap connection structures are "located" at the various positions described herein when at least some portion of the engagement between the strap connection structure 114 and the body member 108 are within the positional ranges described above. For movable strap connection structures, as described in more detail below, the strap connection structure is considered to be "located" at the various positions described herein if at least some portion of the securing structure is capable of being positioned and secured at least partially within the positional ranges described above.

Figure 2A:
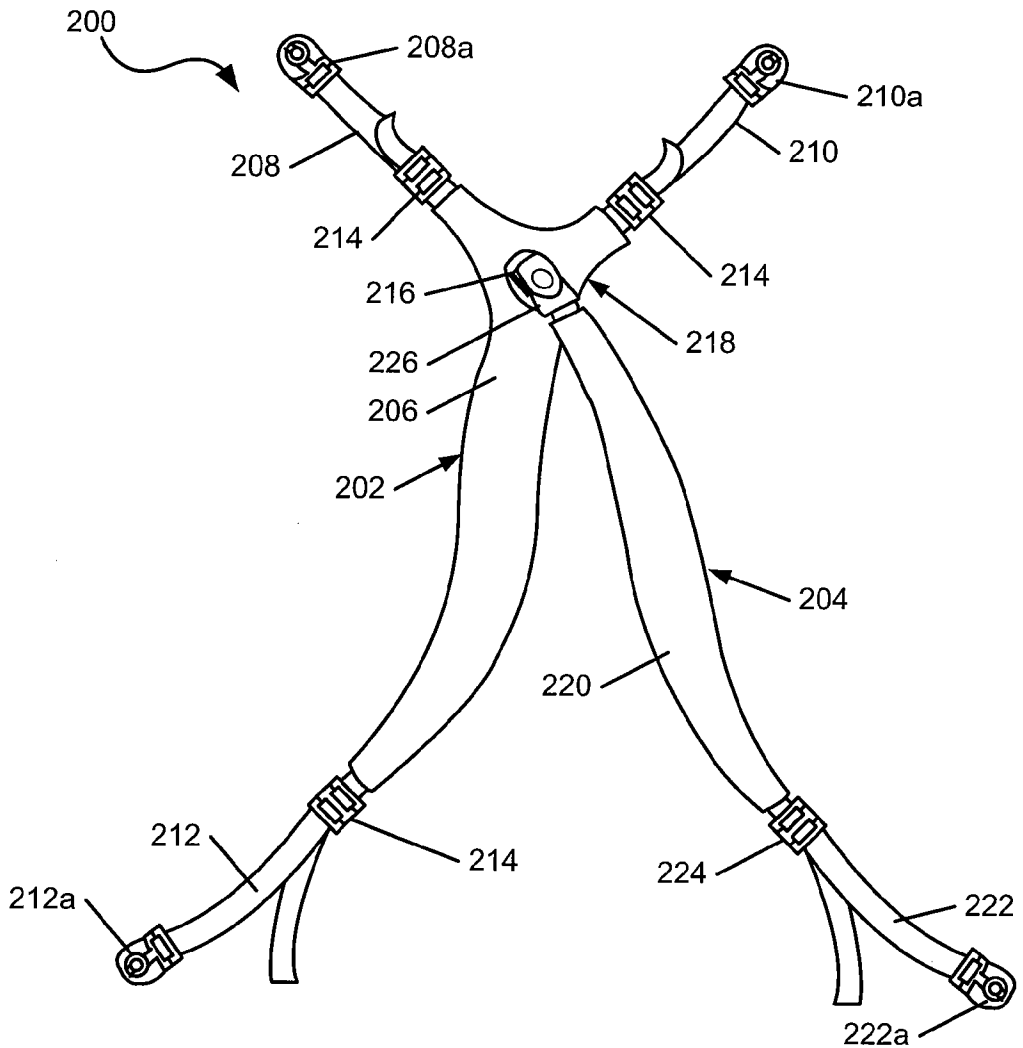
FIGS. 2A through 2C illustrate an example strapping system that may be used in systems and methods in accordance with examples of this invention.
Figure 2C:
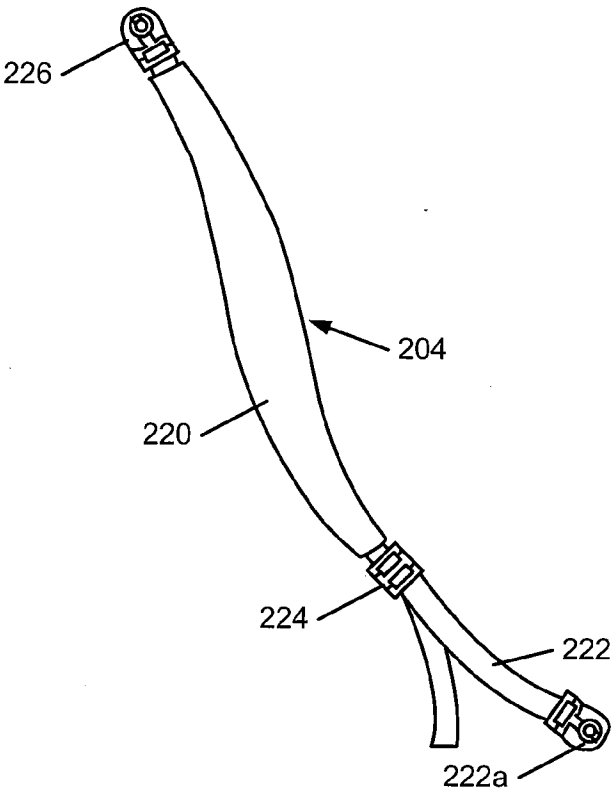
Figure 2B:
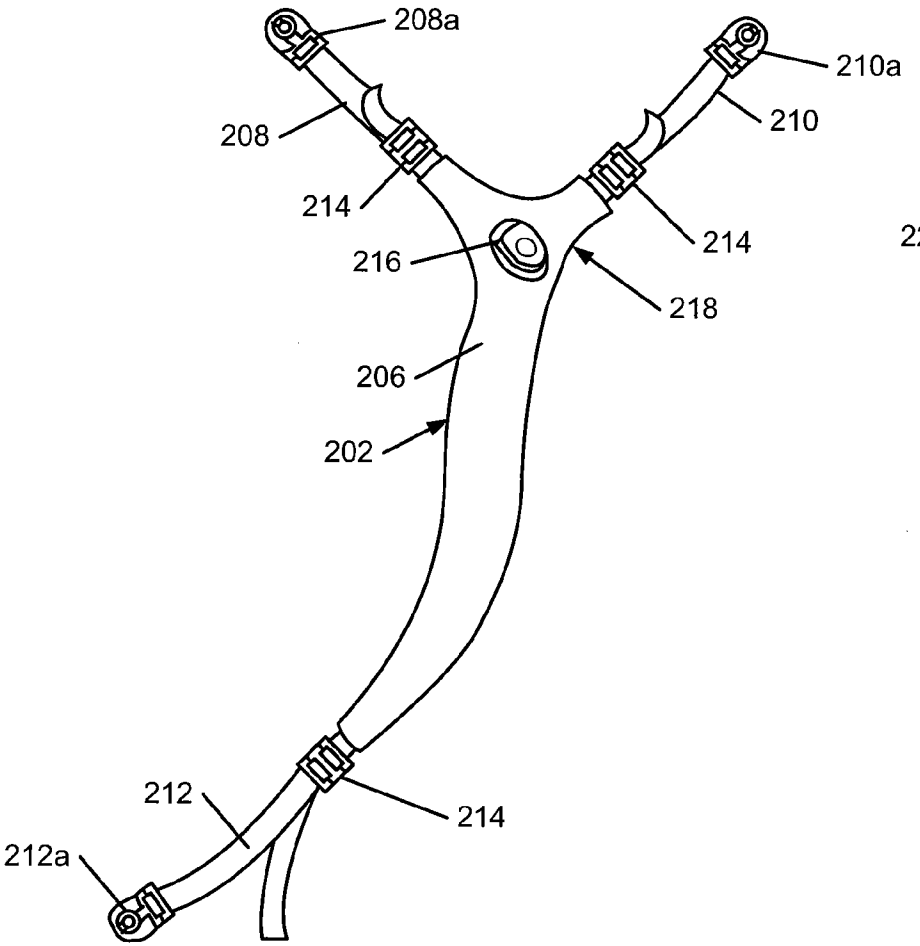

FIGS. 2A through 2C illustrate an example strap system 200 that may be used to carry a golf bag, like bag 100 illustrated in FIG. 1. This strap system 200 includes a first strap member 202 (see also FIG. 2B) and a second strap member 204 (see also FIG. 2C). As shown in FIGS. 2A and 2B, the first strap member 202 includes a base portion 206 that includes at least the portion of the first strap member 202 that will contact the user's shoulders and back while in use. This base portion 206 (or at least some portion thereof) may include foam, padding, air bladders, and/or other constructions that make it lightweight and comfortable for the wearer to use. The base portion 206 of this example strap member structure 202 includes three free ends, and in this illustrated example, each free end has a strap member 208, 210, and 212 attached to it. The strap members 208, 210, and 212 may include length adjusting mechanisms 214, e.g., as are known and used in the art. Each free end of the strap members 208, 210, and 212 has a respective strap connector 208*a*, 210*a*, and 212*a* included thereon or engaged with it. The strap connectors 208*a*, 210*a*, and 212*a* may pivotally and/or rotationally engage one or more of the strap connection structures 114*a* through 114*f*, as will be described in more detail below.

The first strap member 202 of this example strap system 200 includes a strap connection structure 216. While the strap connection structure 216 may be located at any desired location on the first strap member 202, in accordance with some examples of this invention, the strap connection structure 216 will be located at a central hub area 218 of the base portion 206 that forms the origin of the strap structures and/or corresponds to a location of the user's back when the strap system 200 is engaged with the bag 100 and used in a double strap configuration (see also FIG. 4).

FIGS. 2A and 2C illustrate further features of the second strap member 204 in accordance with this example of the invention. As shown, second strap member 204 includes a base portion 220 that includes at least the portion of the second strap member 204 that will contact the user's shoulders and/or back while in use. This base portion 220 (or at least some portion thereof) may include foam, padding, air bladders, and/or other constructions that make it lightweight and comfortable for the wearer to use. The base portion 220 of this example second strap structure 204 includes two free ends. One of the free ends has a strap member 222 attached to it, and this strap member 222 may include a length adjusting mechanism 224, e.g., as is known and used in the art. The free end of strap member 222 has a respective strap connector 222*a* included thereon or engaged with it. The strap connector 222*a* may pivotally and/or rotationally engage one or more of the strap connection structures 114*a* through 114*f*, as will be described in more detail below.

The other free end of the second strap member 204 includes a strap connector 226, optionally mounted on a strap that may or may not include a strap length adjusting mechanism. This strap connector 226 releasably joins to the strap connection structure 216 provided on the first strap member 202 in a rotational or pivotal manner when the strap system 200 is in the double strap configuration (see also FIG. 4). If desired, the first strap member 202 may include the strap connector 226 and the second strap member 204 may include the strap connection structure 216 without departing from this invention. Other structural arrangements and/or releasable strap connection structures and techniques may be used without departing from this invention.

While any desired type of connection between the various strap members and the strap members and the bag may be used without departing from this invention, FIGS. 3A through 3D illustrate some example structures, and these structures will be described in more detail below. While FIGS. 3A through 3D illustrate the connection between the first strap member 202 and the second strap member 204 at the strap connection structure 216 and strap connector 226, those skilled in the art will understand that the same or similar strap connection structures and strap connectors may be used at other locations on the golf bag 100 and strap system 200 combination structure including at strap connection structures 114. Moreover, not all of the strap connection structures and/or the strap connectors on a given golf bag need have the same structure. Rather, different structures and different releasable connection mechanisms may be used at different locations without departing from this invention.

Figure 3A:
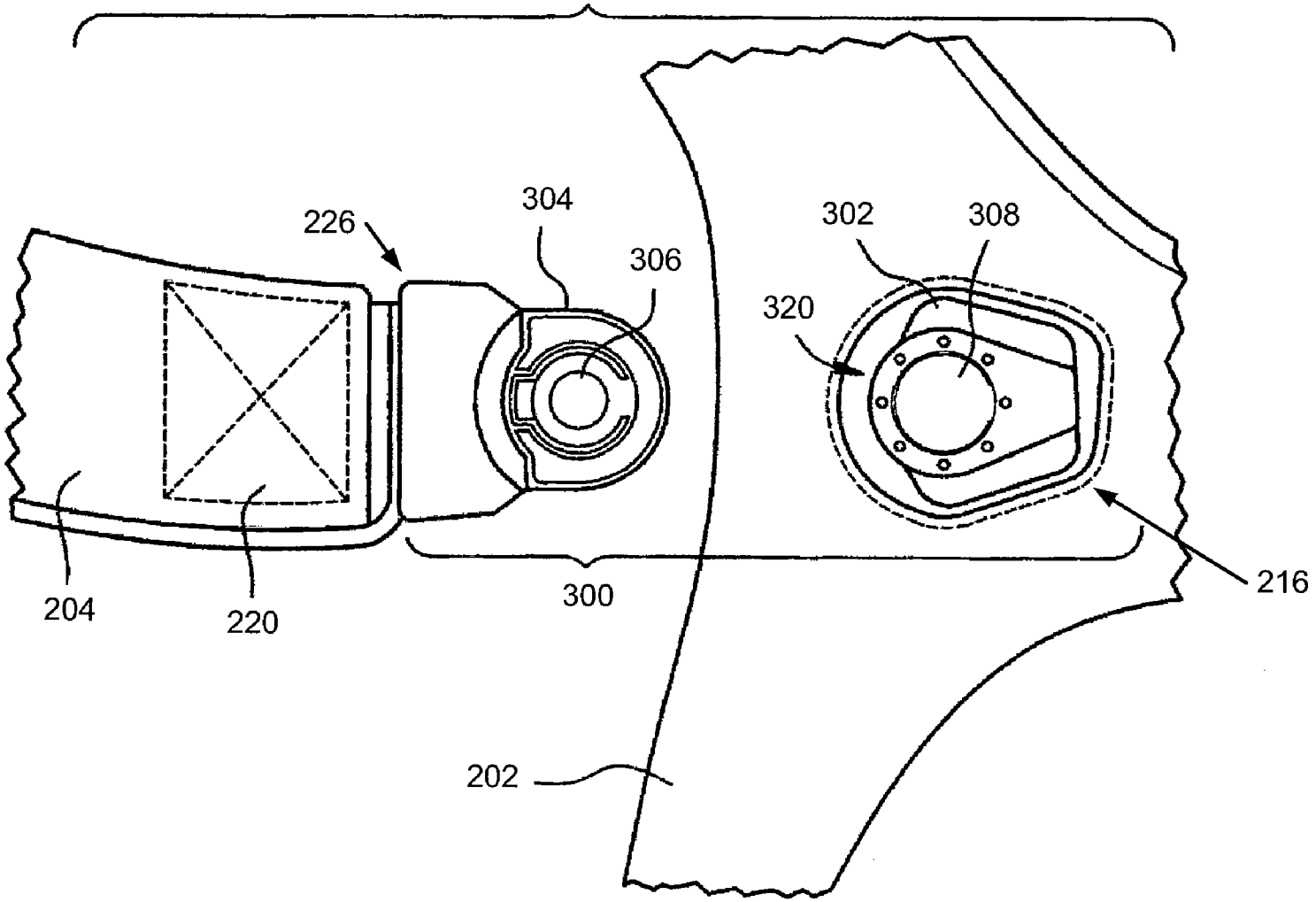
FIGS. 3A through 3D illustrate various features of example strap connectors and strap connection structures that may be used in systems and methods according to this invention.
Figure 3B:
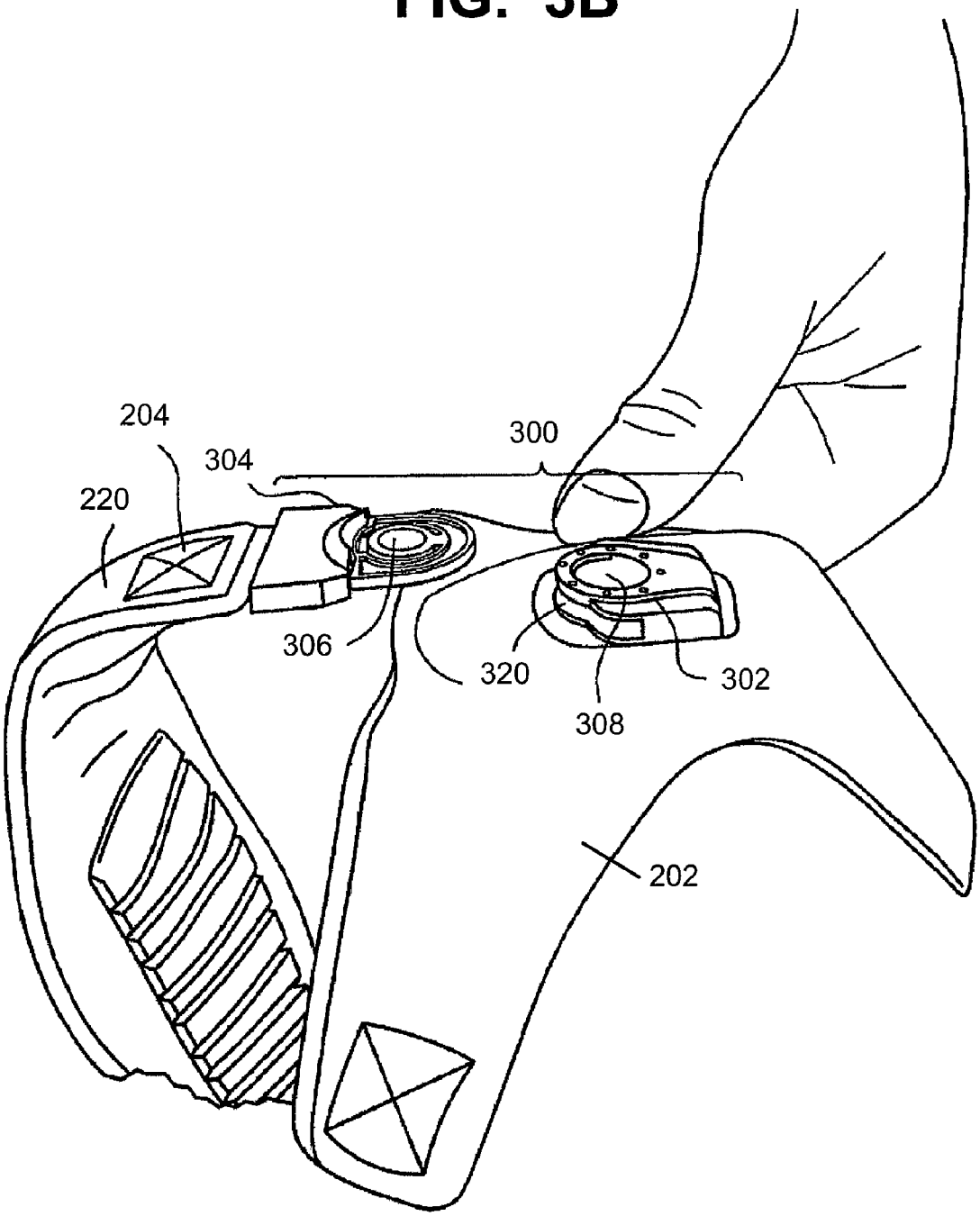
Figure 3C:
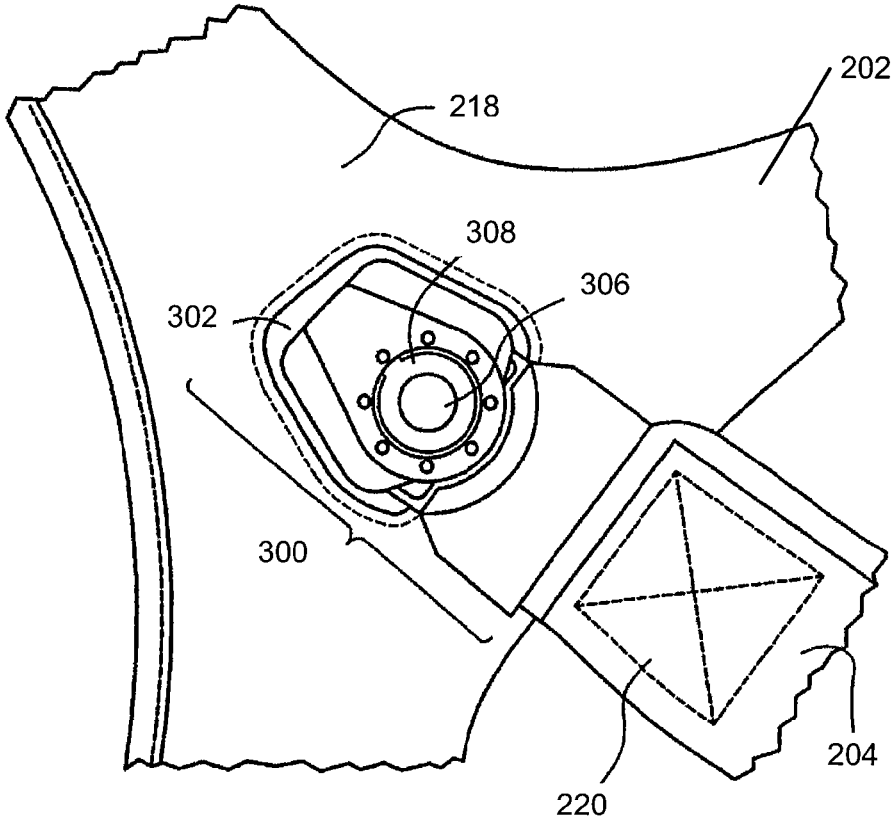
Figure 3D:
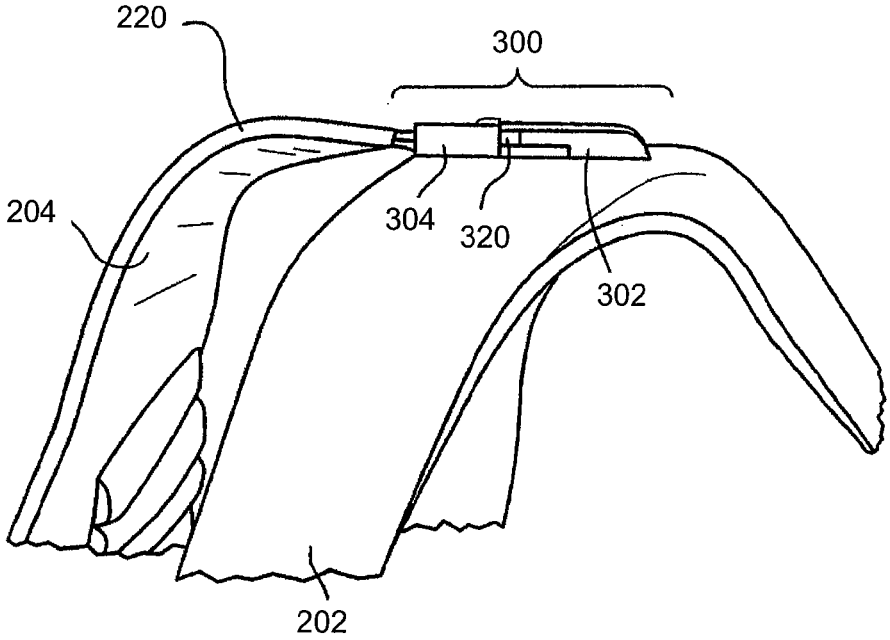

FIGS. 3A through 3D illustrate overhead and side views of an example movable connection joint 300 that comprises a pivotable and releasable strap connection for a golf bag strap in the form of a pivot snap buckle. FIGS. 3A and 3B illustrate the movable connection joint 300 in a disengaged position (an overhead view and a side view, respectively), while FIGS. 3C and 3D illustrate the movable connection joint 300 in an engaged position (an overhead view and a side view, respectively). As illustrated, the connection joint 300, which is in the form of a pivot snap buckle in this example, may have two or more components. The strap connection structure 216 or component is a receptor component 302 that is fixedly or removably attached to first strap member 202 (or to another appropriate structure, such as bag body member 108). In some example structures, receptor component 302 is a plastic molding that defines an opening or slot 320 into which another part of the connection joint 300 is received (see FIGS. 3B and 3D). However, as would be apparent to one of skill in the art, receptor component 302 may take other forms or be made from other materials without departing from the spirit and scope of the present invention. For example, in other embodiments, receptor component 302 may be made of a metallic material or, alternatively, of some kind of fabric. As still another example, the opening or slot 320 may be defined between a portion of the receptor component 302 and the strap member 202. If necessary or desired, the hub area 218 where the receptor component 302 is mounted may include plastic materials and/or other reinforcements or mounting structures (e.g., to assure a strong, stable connection of the receptor component 302 to the hub area 218). Optionally, if necessary, additional padding may be provided at the hub area 218, particularly at the location of the receptor component 302, to moderate the feel of the hub area 218 and/or receptor component 302 on the user's back (see FIG. 4). Other arrangements and configurations are possible without departing from the invention.

A second component of the connection joint 300 (e.g., the pivot snap buckle) according to this example of the invention is snap-in piece 304 that may be fixedly or removably attached to second strap member 204. As shown by comparing FIGS. 3A and 3B with FIGS. 3C and 3D, respectively, and as will be explained in more detail below, inserting snap-in piece 304 connected to second strap member 204 into receptor component 302 of the first strap member 202 causes snap-in piece 304 to snap into place within the receptor component 302, thus coupling the first strap member 202 with the second strap member 204.

In some connection joint structures 300, snap-in piece 304 may be removably engaged within the receptor component 302 such that the second strap member 204 may be disengaged from the first strap member 202 by the user. In one example, snap-in piece 304 may include a raised and movable button 306 that compresses inward as it is slid through the opening or slot 320 defined in the receptor component 302. Once through the slot 320 and located within the opening 308 defined in the receptor component 302, the movable button 306 snaps back outward into place inside the opening 308 of the receptor component 302 by elevating outward toward its original position. In this manner, the outer edges of button 306 engage with and are trapped within opening 308, thereby holding the button 306 within the opening 308. The snap-in piece 304 may be removed from receptor component 302 by depressing button 306 until its edges are below opening 308 and then sliding the snap-in piece 304 out of receptor component 302.

Figure 4:
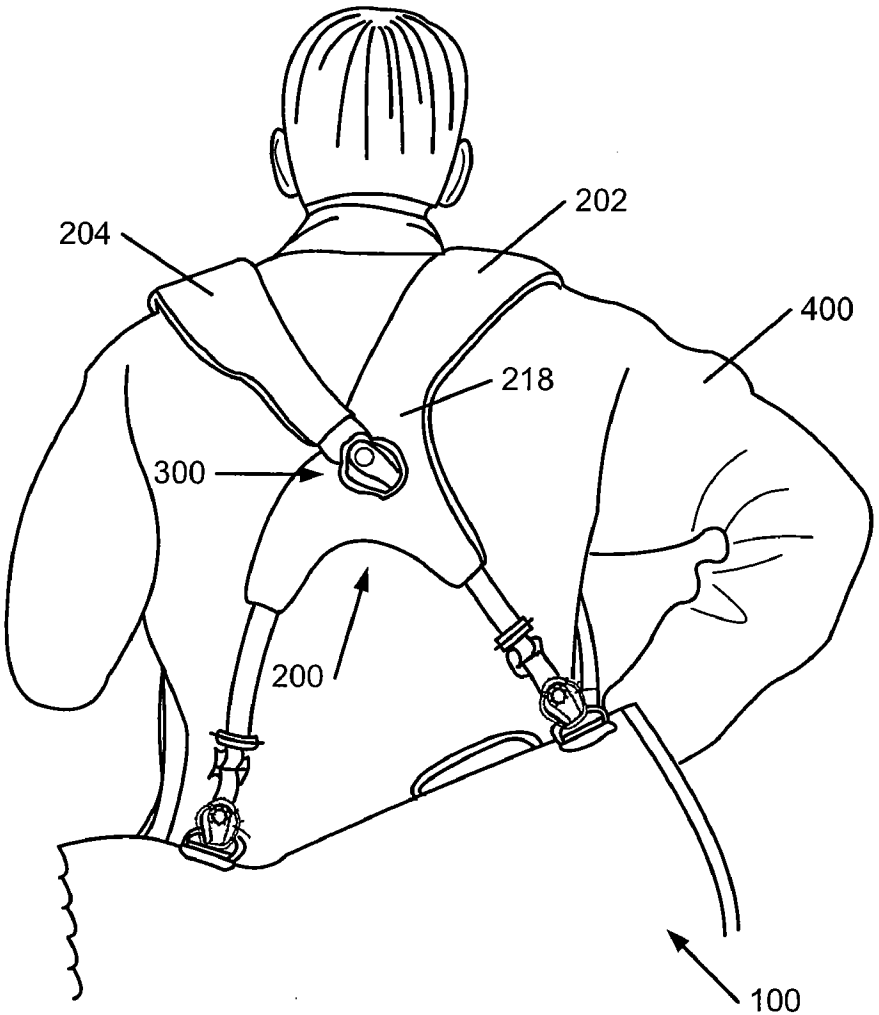
FIG. 4 illustrates an example golf bag and strapping system combination in a double strap carrying configuration.

FIG. 4 illustrates the golf bag 100 and strap system 200 in accordance with an example of this invention in use, carried on the back of a user 400 in a double strap configuration. As noted above, the hub area 218 of the first strap member 202 may include extra padding to help moderate the feel of the connection joint 300 and provide a more comfortable structural arrangement.

Figure 5A:
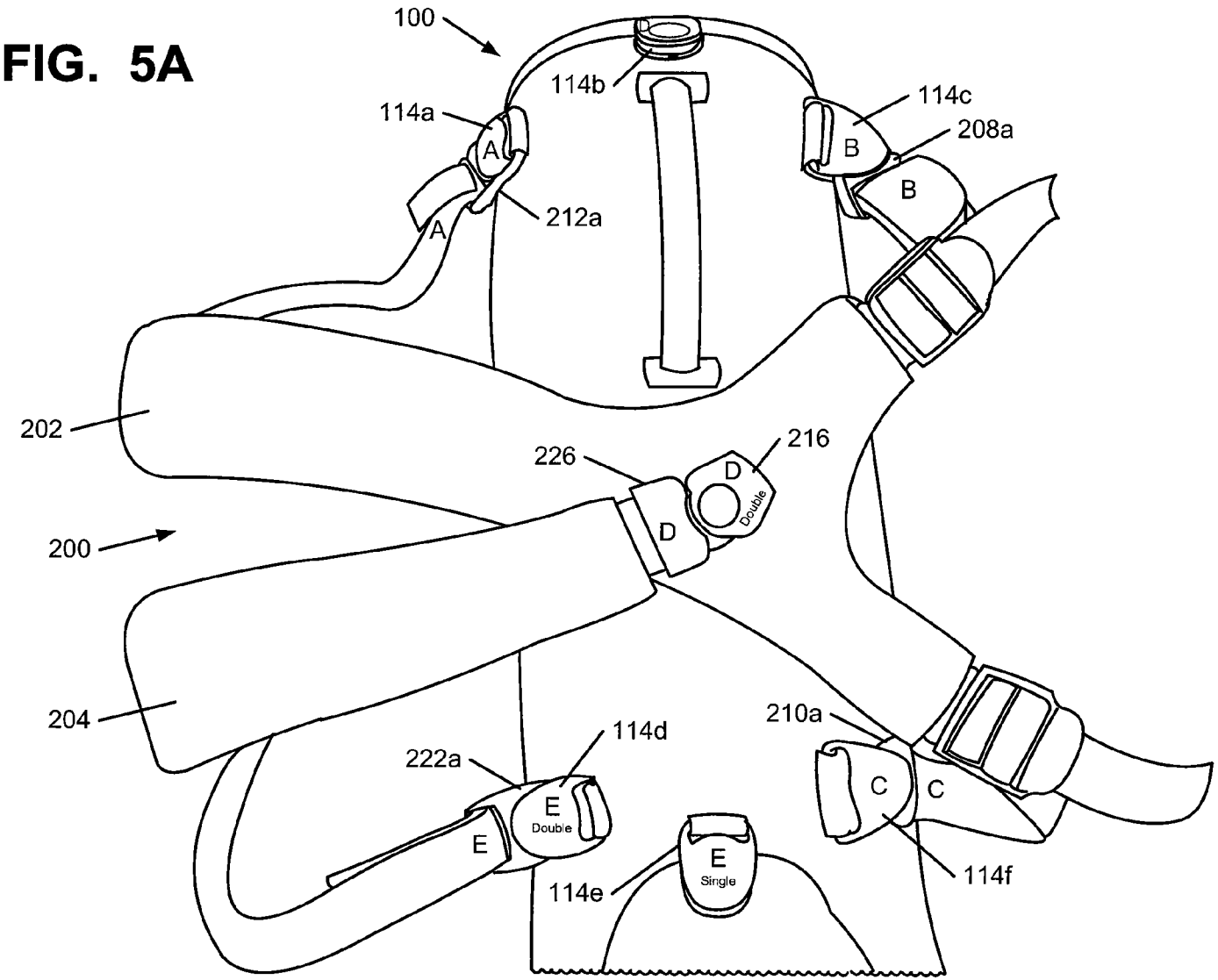
FIGS. 5A through 5C illustrate various features of an example golf bag and strapping system combination in accordance with this invention, including example steps involved in converting the strap system from the double strap configuration to the single strap configuration.
Figure 5B:
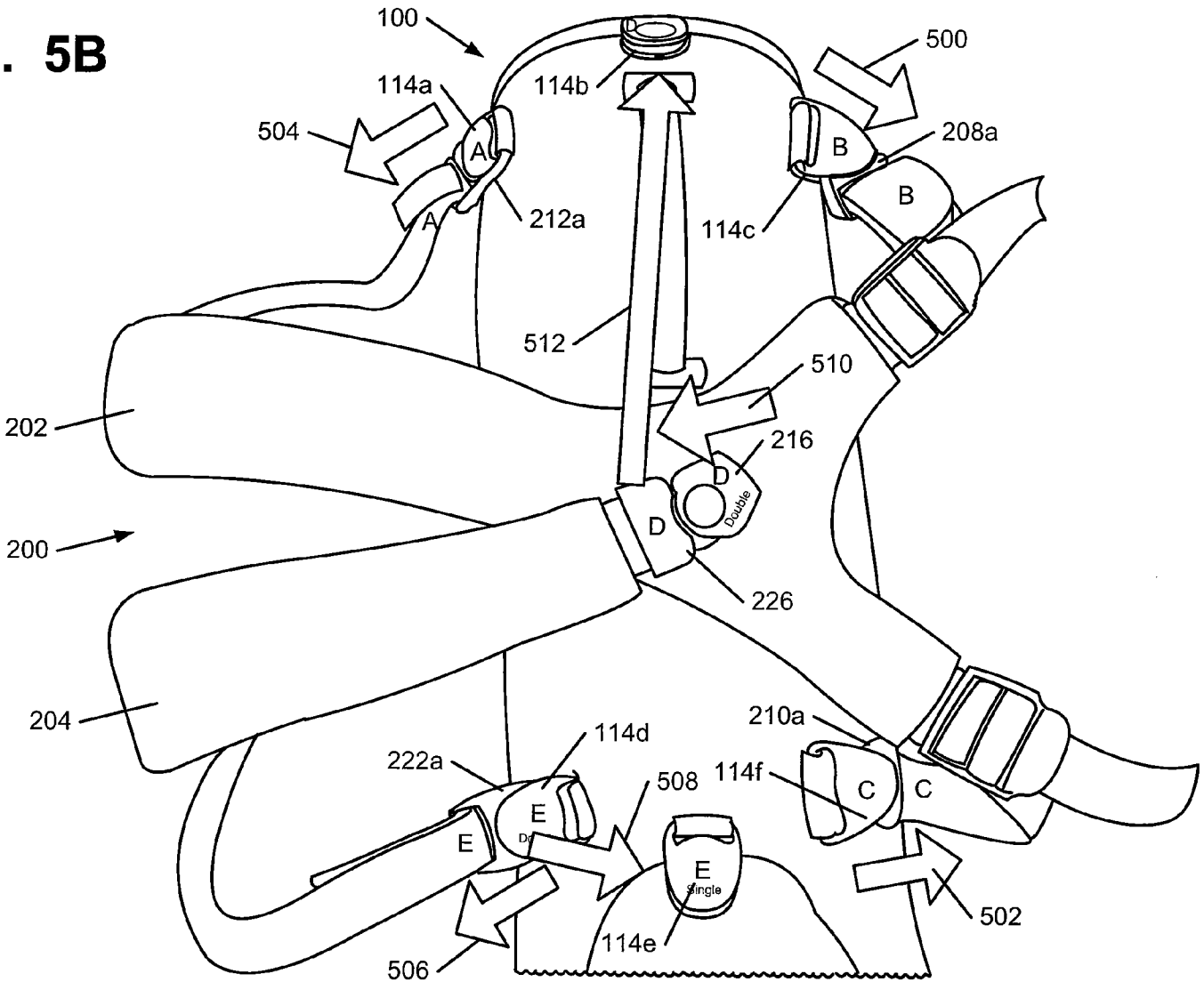
Figure 5C:
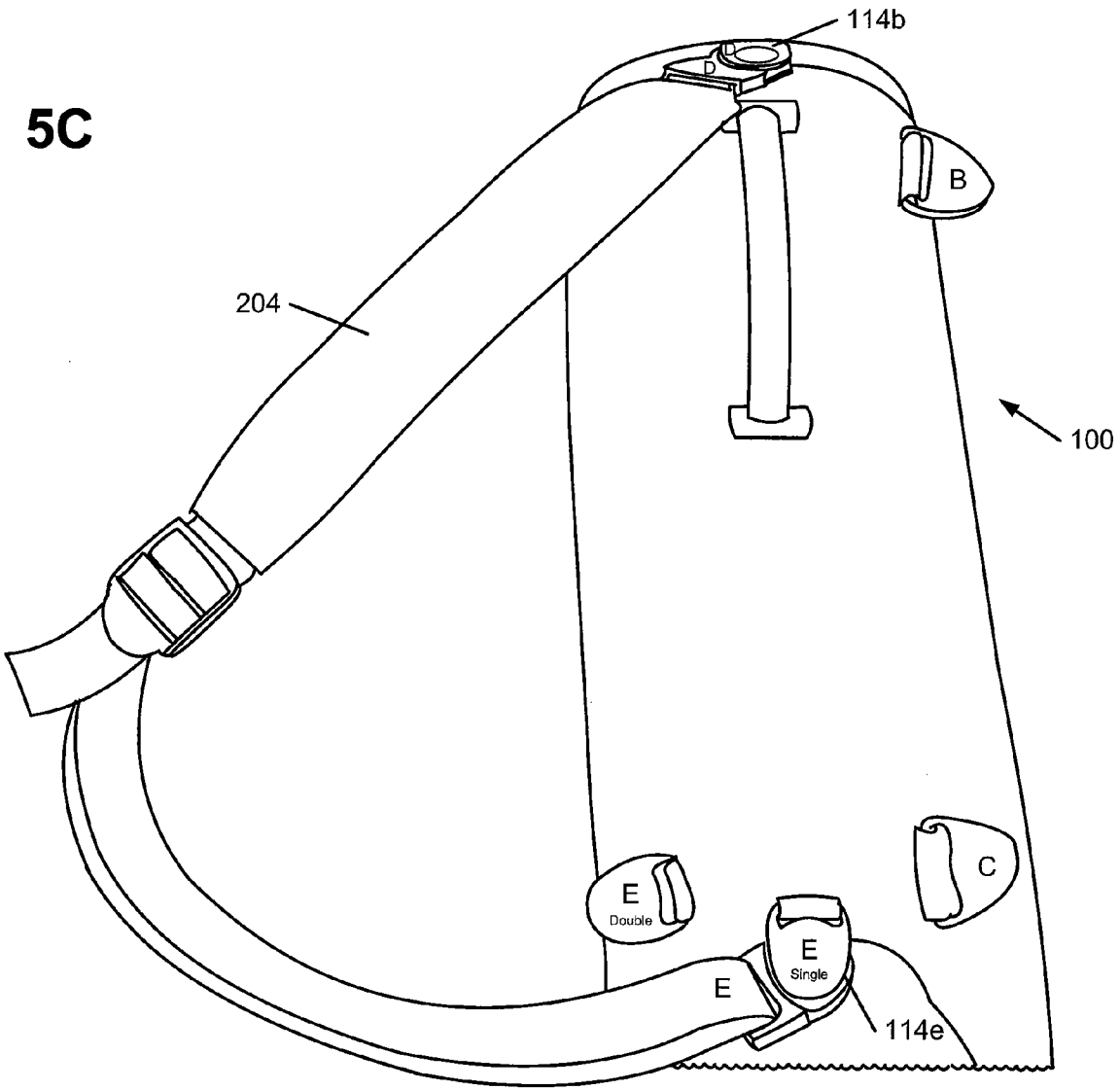

FIGS. 5A through 5C illustrate conversion of the strap system 200 between a double strap configuration (e.g., as shown in FIGS. 4, 5A, and 5B) to a single strap configuration (e.g., as shown in FIG. 5C). FIG. 5A illustrates the bag 100 having the strap system 200 in the double strap configuration. In this illustrated example, the strap system 200 is engaged with the bag 100 as follows:

(a) strap connector 208*a* (of the first strap member 202) is engaged with strap connection structure 114*c*,
(b) strap connector 210*a* (of the first strap member 202) is engaged with strap connection structure 114*f*,
(c) strap connector 212*a* (of the first strap member 202) is engaged with strap connection structure 114*a*,
(d) strap connector 222*a* (of the second strap member 204) is engaged with strap connection structure 114*d*,
(e) strap connector 226 (of the second strap member 204) is engaged with the strap connection structure 216 (of the first strap member 202), and
(f) strap connection structures 114*b* and 114*e* are un-utilized.

To convert this double strap configuration to a single strap configuration, the straps are reconfigured as shown in FIG. 5B and as described below:

(a) strap connector 208*a* (of the first strap member 202) is disconnected from strap connection structure 114*c* (see arrow 500),
(b) strap connector 210*a* (of the first strap member 202) is disconnected from strap connection structure 114*f* (see arrow 502),
(c) strap connector 212*a* (of the first strap member 202) is disconnected from strap connection structure 114*a* (see arrow 504),
(d) strap connector 222*a* (of the second strap member 204) is disconnected from strap connection structure 114*d* (see arrow 506) and then engaged with strap connection structure 114*e* (see arrow 508), and
(e) strap connector 226 (of the second strap member 204) is disconnected from strap connection structure 216 (of the first strap member) (see arrow 510) and then engaged with strap connection structure 114*b* (see arrow 512).

The results of these changes are shown in FIG. 5C. As shown, in the single strap arrangement of this example system, the second strap member 204 is engaged with the centrally located strap connection structures 114*b* and 114*e*, and the first strap member 202 is completely removed from the various strap connection structures 114*a* through 114*f* (and optionally stored in a pocket provided in the bag structure 100). Notably, using this conversion arrangement and structure, none of the strap connection structures used in the double strap configuration (114*a*, 114*c*, 114*d*, and 114*f*) is used in the single strap configuration and vice versa.

If desired, the strap system 200 arrangement shown in FIGS. 5A through 5C could be flipped vertically. In this arrangement, the strap system 200 will be engaged with the bag 100 as follows:

(a) strap connector 210*a* (of the first strap member 202) is engaged with strap connection structure 114*c*,
(b) strap connector 208*a* (of the first strap member 202) is engaged with strap connection structure 114*f*,
(c) strap connector 212*a* (of the first strap member 202) is engaged with strap connection structure 114*d*,
(d) strap connector 222*a* (of the second strap member 204) is engaged with strap connection structure 114*a*,
(e) strap connector 226 (of the second strap member 204) is engaged with the strap connection structure 216 (of the first strap member 202), and
(f) strap connection structures 114*b* and 114*e* are un-utilized.

To convert this double strap configuration to a single strap configuration, the straps are reconfigured to the arrangement shown in FIG. 5C and as described below:

(a) strap connector 210*a* (of the first strap member 202) is disconnected from strap connection structure 114*c*,
(b) strap connector 208*a* (of the first strap member 202) is disconnected from strap connection structure 114*f*,
(c) strap connector 212*a* (of the first strap member 202) is disconnected from strap connection structure 114*d*,
(d) strap connector 222*a* (of the second strap member 204) is disconnected from strap connection structure 114*a* and then engaged with strap connection structure 114*e*, and
(e) strap connector 226 (of the second strap member 204) is disconnected from strap connection structure 216 (of the first strap member) and then engaged with strap connection structure 114*b*.

If necessary, the shape of the first strap member 202 and/or the seconds strap member 204 may be changed somewhat for this arrangement, e.g., to allow strap connector 212*a* to better align with and connect to lower strap connector 114*d*.

In a similar manner, the strap system 200 could be flipped horizontally from the two arrangements described above. In other words, the strap system 200 may be constructed and arranged so that strap connectors 208*a* and 210*a* engage with strap connection structures 114*a* and 114*d*, respectively, and so that the strap connectors 212*a* and 222*a* engage with strap connection structures 114*c* and 114*f*, respectively. In another arrangement, the strap system 200 may be constructed and arranged so that strap connectors 208*a* and 210*a* engage with strap connection structures 114*d* and 114*a*, respectively, and so that the strap connectors 212*a* and 222*a* engage with strap connection structures 114*f* and 114*d*, respectively. In either of these arrangements, the second strap member 204 may be engaged with the bag structure 100 in the manner shown in FIG. 5C for the corresponding single strap configuration.

FIGS. 5A through 5C show additional features that may be included in golf bag 100 and strapping systems 200 in accordance with at least some examples of this invention. As shown in these figures, the various straps and/or the strap connectors engaged therewith may be coded in some manner, as may the various strap connection structures. This coding can help assure that the strap connectors are engaged with the proper strap connection structures to place the straps in the correct positions for the single and double strap configurations. While any type of coding may be used without departing from this invention, in this illustrated example, the strap members and/or strap connectors include letter codes that match up with letter codes provided on the strap connection structures. The connection structures 114*b*, 114*d*, 114*e*, and 216 may include further coding to indicate whether that connection structure is to be used in the single strap configuration or the double strap configuration (as indicated by the words "single" and "double" in FIGS. 5A through 5C). Other coding arrangements are possible without departing from this invention, such as numerical matching codes, color matching codes, textual information, etc.

As another alternative, rather than using codes on the strap connectors and/or strap connection structures, the strap connectors and strap connection structures could be structured so that the strap connectors will only engage with the proper strap connection structures and will not engage with incorrect strap connection structures. As some more specific examples, the sizes of the receptor components 302 and/or snap-in pieces 304 may be selected so that a strap connector will only fit within the openings of strap connection structures with which it is intended to engage.

Figure 6:
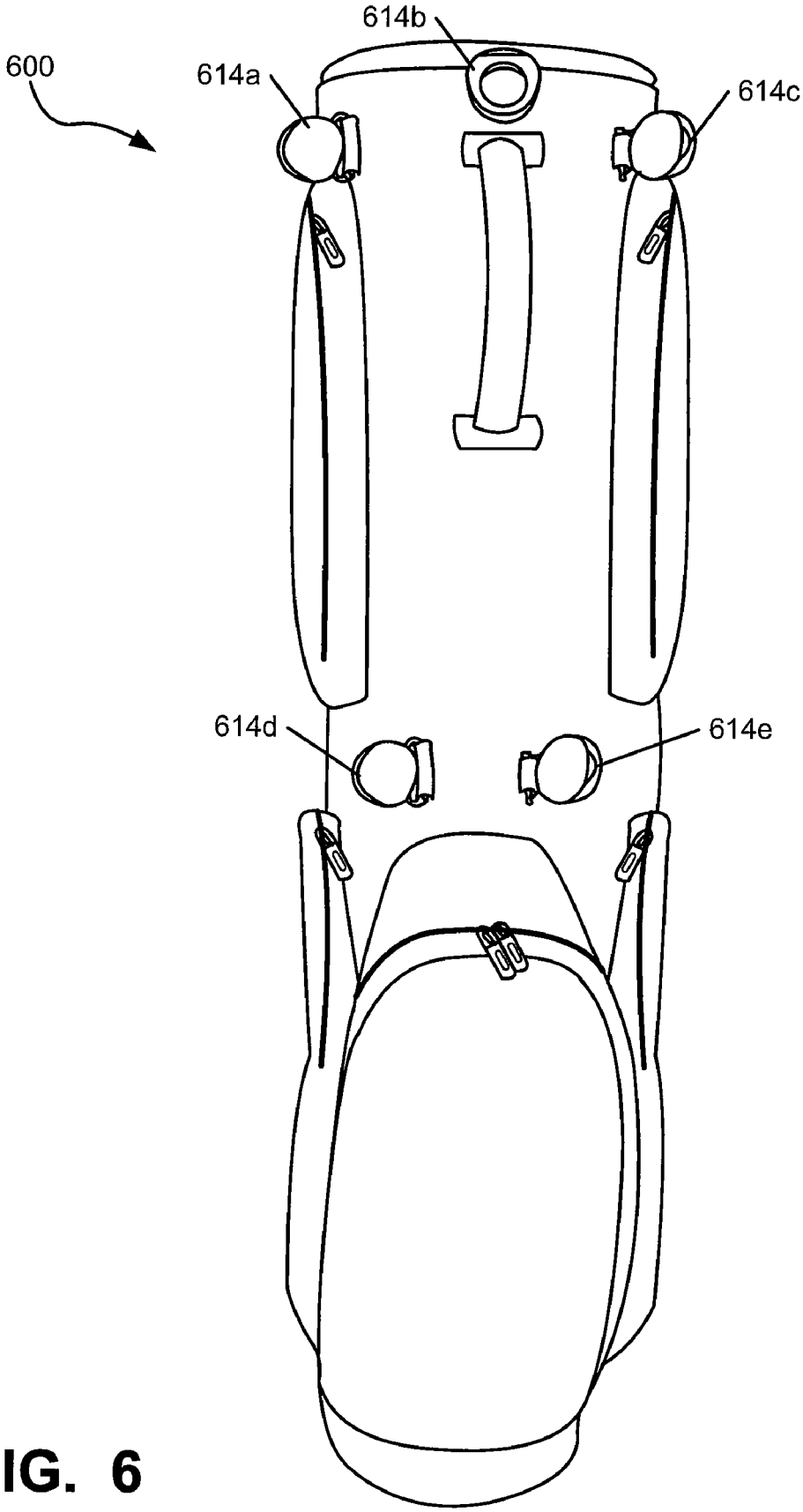
FIGS. 6-9 illustrate various additional examples of golf bag structures in accordance with this invention.

FIG. 6 illustrates another golf bag structure 600 in accordance with some examples of this invention that may be used in conjunction with the strap system 200 described above.

While the structure and arrangement of the various structures on the golf bag 600 may be the same as or similar to those described above for bag 100 (including the various optional, alternative, and/or additional features described above), this golf bag structure 600 differs from the golf bag structure 100 in that only five strap connection structures 614*a* through 614*e* are provided (as opposed to the six strap connection structures 114*a* through 114*f* described above). In the arrangement of FIG. 6, three strap connection structures 614*a* through 614*c* are located proximate to the top of the bag and two strap connection structures 614*d* and 614*e* are located longitudinally downward from these upper strap connection structures 614*a* through 614*c*.

The bag structure 600 of FIG. 6 also may be used with strap system 200 and also may be converted between a double strap configuration and a single strap configuration. In the double strap configuration, the strap system 200 may be engaged with the bag 600 as follows:

(a) strap connector 208*a* (of the first strap member 202) is engaged with strap connection structure 614*c*,
(b) strap connector 210*a* (of the first strap member 202) is engaged with strap connection structure 614*e*,
(c) strap connector 212*a* (of the first strap member 202) is engaged with strap connection structure 614*a*,
(d) strap connector 222*a* (of the second strap member 204) is engaged with strap connection structure 614*d*,
(e) strap connector 226 (of the second strap member 204) is engaged with the strap connection structure 216 (of the first strap member 202), and
(f) strap connection structure 614*b* is un-utilized.

To convert this double strap configuration to a single strap configuration, the straps are reconfigured as described below:

(a) strap connector 208*a* (of the first strap member 202) is disconnected from strap connection structure 614*c*,
(b) strap connector 210*a* (of the first strap member 202) is disconnected from strap connection structure 614*e*,
(c) strap connector 212*a* (of the first strap member 202) is disconnected from strap connection structure 614*a*,
(d) strap connector 222*a* (of the second strap member 204) remains connected to strap connection structure 614*d* (or alternatively, it may be connected to strap connection structure 614*e*), and
(e) strap connector 226 (of the second strap member 204) is disconnected from strap connection structure 216 (of the first strap member) and then engaged with strap connection structure 614*b*.

If desired, as illustrated in FIG. 6, the lower strap connection structures 614*d* and 614*e* may be placed somewhat closer to the center line of the bag 600 (closer to the circumferential location of strap connection structure 614*b*) so that in the single strap configuration the strap member 204 will more closely align with the longitudinal direction L.

If desired, the strap system 200 arrangement described above could be flipped vertically. In this arrangement, the strap system 200 will be engaged with the bag 600 as follows:

(a) strap connector 210*a* (of the first strap member 202) is engaged with strap connection structure 614*c*,
(b) strap connector 208*a* (of the first strap member 202) is engaged with strap connection structure 614*e*,
(c) strap connector 212*a* (of the first strap member 202) is engaged with strap connection structure 614*d*,
(d) strap connector 222*a* (of the second strap member 204) is engaged with strap connection structure 614*a*,
(e) strap connector 226 (of the second strap member 204) is engaged with the strap connection structure 216 (of the first strap member 202), and
(f) strap connection structure 614*b* is un-utilized.

To convert this double strap configuration to a single strap configuration, the straps are reconfigured as described below:

(a) strap connector 210*a* (of the first strap member 202) is disconnected from strap connection structure 614*c*,
(b) strap connector 208*a* (of the first strap member 202) is disconnected from strap connection structure 614*e*,
(c) strap connector 212*a* (of the first strap member 202) is disconnected from strap connection structure 614*d*,
(d) strap connector 222*a* (of the second strap member 204) is disconnected from strap connection structure 614*a* and is then engaged with either of strap connection structures 614*d* and 614*e*, and
(e) strap connector 226 (of the second strap member 204) is disconnected from strap connection structure 216 (of the first strap member) and then engaged with strap connection structure 614*b*.

If necessary, the shapes of the first strap member 202 and/or the second strap member 204 may be changed somewhat for this arrangement, e.g., to allow strap connector 212*a* to better align with and connect to strap connector 614*d*.

In a similar manner, the strap system 200 could be flipped horizontally on bag 600 from the two arrangements described above. In other words, the strap system 200 may be constructed and arranged so that strap connectors 208*a* and 210*a* engage with strap connection structures 614*a* and 614*d*, respectively, and so that the strap connectors 212*a* and 222*a* engage with strap connection structures 614*c* and 614*e*, respectively. In another arrangement, the strap system 200 may be constructed and arranged so that strap connectors 208*a* and 210*a* engage with strap connection structures 614*d* and 614*a*, respectively, and so that the strap connectors 212*a* and 222*a* engage with strap connection structures 614*e* and 614*c*, respectively. In either of these arrangements, the second strap member 204 may be engaged with the bag structure 600 in the manner described above for the corresponding single strap configuration.

Figure 7:
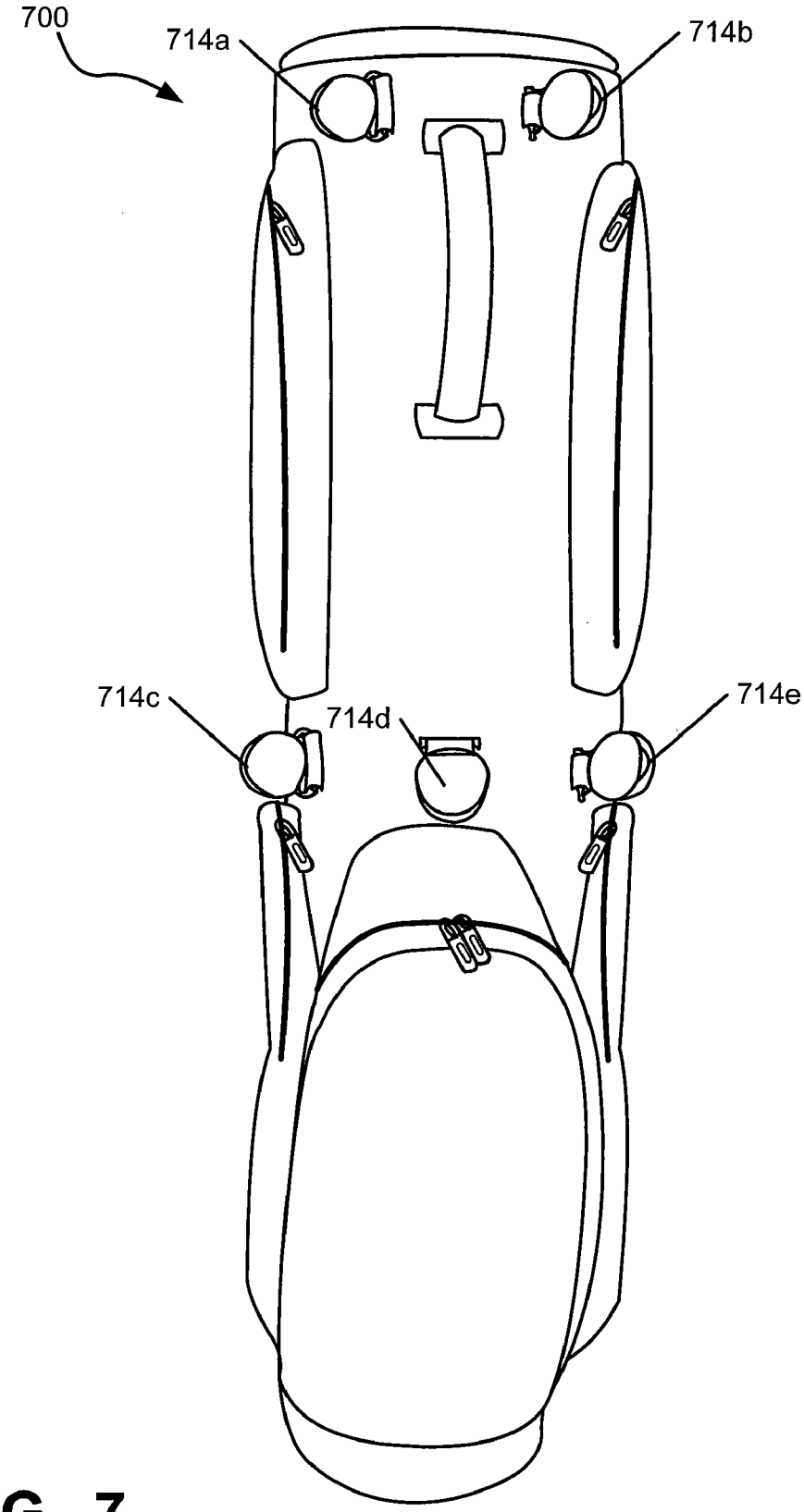

FIG. 7 illustrates another golf bag structure 700 in accordance with some examples of this invention that may be used in conjunction with the strap system 200 described above. While the structure and arrangement of the various structures on the golf bag 700 may be the same as or similar to those described above for bag 100 (including the various optional, alternative, and/or additional features described above), this golf bag structure 700 differs from the golf bag structure 100 in that only five strap connection structures 714*a* through 714*e* are provided (as opposed to the six strap connection structures 114*a* through 114*f* described above). The golf bag structure 700 of FIG. 7 has the five strap connection structures arranged such that two are located proximate the top of the bag 700 and three are located lower on the bag structure 700 (and in this manner, the bag 700 differs from the bag structure 600 described above in conjunction with FIG. 6).

The bag structure 700 of FIG. 7 may be used with strap system 200 and also may be converted between a double strap configuration and a single strap configuration. In the double strap configuration, the strap system 200 may be engaged with the bag 700 as follows:

(a) strap connector 208*a* (of the first strap member 202) is engaged with strap connection structure 714*b*,
(b) strap connector 210*a* (of the first strap member 202) is engaged with strap connection structure 714*e*,
(c) strap connector 212*a* (of the first strap member 202) is engaged with strap connection structure 714*a*,
(d) strap connector 222*a* (of the second strap member 204) is engaged with strap connection structure 714*c*, (e) strap connector 226 (of the second strap member 204) is engaged with the strap connection structure 216 (of the first strap member 202), and (f) strap connection structure 714*d* is un-utilized.

To convert this double strap arrangement to a single strap configuration, the straps are reconfigured as described below:

(a) strap connector 208*a* (of the first strap member 202) is disconnected from strap connection structure 714*b*, (b) strap connector 210*a* (of the first strap member 202) is disconnected from strap connection structure 714*e*, (c) strap connector 212*a* (of the first strap member 202) is disconnected from strap connection structure 714*a*, (d) strap connector 222*a* (of the second strap member 204) is disconnected from strap connection structure 714*c* and is then engaged with strap connection structure 714*d*, and (e) strap connector 226 (of the second strap member 204) is disconnected from strap connection structure 216 (of the first strap member) and then engaged with either of strap connection structure 714*a* or 714*b*.

If desired, as illustrated in FIG. 7, the upper strap connection structures 714*a* and 714*b* may be placed somewhat closer to the center line of the bag 700 (closer to the circumferential location of strap connection structure 714*d*) so that in the single strap configuration the strap member 204 will more closely align with the longitudinal direction L.

If desired, the strap system 200 arrangement described above could be flipped vertically. In this arrangement, the strap system 200 will be engaged with the bag 700 as follows:

(a) strap connector 210*a* (of the first strap member 202) is engaged with strap connection structure 714*b*, (b) strap connector 208*a* (of the first strap member 202) is engaged with strap connection structure 714*e*, (c) strap connector 212*a* (of the first strap member 202) is engaged with strap connection structure 714*c*, (d) strap connector 222*a* (of the second strap member 204) is engaged with strap connection structure 714*a*, (e) strap connector 226 (of the second strap member 204) is engaged with the strap connection structure 216 (of the first strap member 202), and (f) strap connection structure 714*d* is un-utilized.

To convert this double strap arrangement to a single strap configuration, the straps are reconfigured as described below:

(a) strap connector 210*a* (of the first strap member 202) is disconnected from strap connection structure 714*b*, (b) strap connector 208*a* (of the first strap member 202) is disconnected from strap connection structure 714*e*, (c) strap connector 212*a* (of the first strap member 202) is disconnected from strap connection structure 714*c*, (d) strap connector 222*a* (of the second strap member 204) is disconnected from strap connection structure 714*a* and is then engaged with strap connection structure 714*d*, and (e) strap connector 226 (of the second strap member 204) is disconnected from strap connection structure 216 (of the first strap member) and then engaged with either of strap connection structure 714*a* or 714*b*.

If necessary, the shapes of the first strap member 202 and/or the second strap member 204 may be changed somewhat for this arrangement, e.g., to allow strap connector 212*a* to better align with and connect to strap connector 714*c*.

In a similar manner, the strap system 200 could be flipped horizontally on bag 700 from the two arrangements described above. In other words, the strap system 200 may be constructed and arranged so that in the double strap configuration, strap connectors 208*a* and 210*a* engage with strap connection structures 714*a* and 714*c*, respectively, and so that the strap connectors 212*a* and 222*a* engage with strap connection structures 714*b* and 714*e*, respectively. In another arrangement, the strap system 200 may be constructed and arranged so that in the double strap configuration, strap connectors 208*a* and 210*a* engage with strap connection structures 714*c* and 714*a*, respectively, and so that the strap connectors 212*a* and 222*a* engage with strap connection structures 714*e* and 714*b*, respectively. In either of these arrangements, the second strap member 204 may be engaged with the bag structure 700 in the manner described above for the corresponding single strap configuration.

Figure 8:
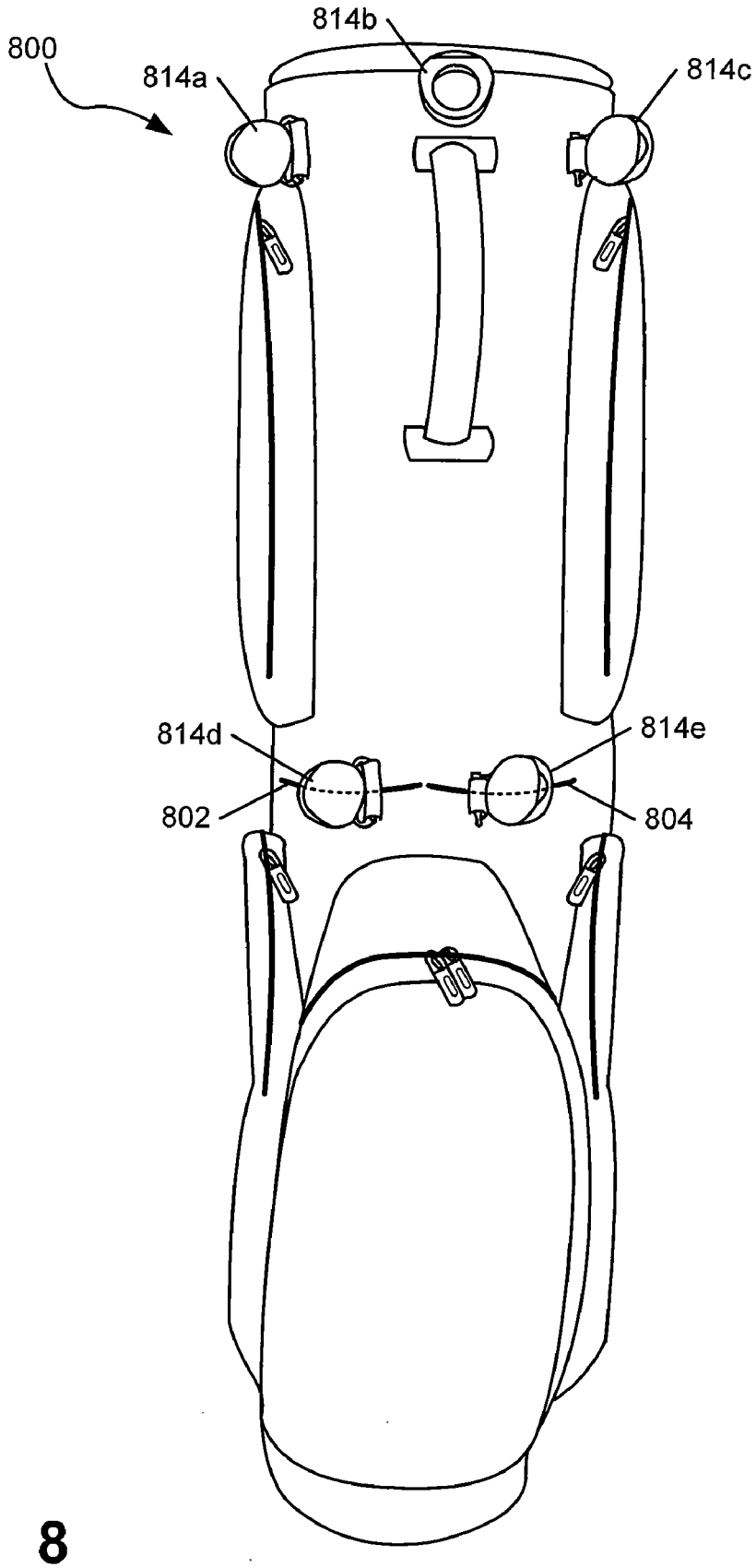

FIG. 8 illustrates additional features that may be included in golf bag 800 and strapping systems (e.g., strapping system 200) in accordance with at least some examples of this invention. This example bag structure 800 is similar in structure to that shown in FIG. 6 in that five strap connection structures 814*a* through 814*e* are shown, three proximate the top and two longitudinally downward from the top. In this example bag structure 800, however, at least one of the lower strap connection structures 814*d* and/or 814*e* is movable with respect to the circumferential direction of the bag structure 800, e.g., along tracks 802 and/or 804, respectively. In this manner, for example, when the bag structure 800 is in the double strap configuration, the lower strap connection structures 814*d* and 814*e* may be moved away from one another so as to provide a wider and stable base for engaging the strap connectors of the strap system 200. When converting to the single strap configuration, at least one of the lower strap connection structures 814*d* and/or 814*e* may be moved to the more central location, to better align with central strap connection structure 814*b*. If desired, the two tracks 802 and 804 may merge to a single track or multiple strap connection structures may be mounted within a single track. Also, the location(s) of the movable strap connection structure(s) may be determined by the user, in either the single or double strap configurations, to best suit the user's personal tastes or comfort.

Any of the strap connection structures 814*a* through 814*e* on the bag 800 may be adjustable in this circumferential manner without departing from this invention, including all of the strap connection structures, any one individual strap connection structure, or any combination of the strap connection structures. Also, this adjustability feature can be provided on any of the other bag structures 100, 600, and/or 700 described above (and any of the additional structures described below). The strap connection structures also may be designed to be movable at least partially in the longitudinal direction, e.g., by making the tracks 802 and/or 804 angle upward and/or downward, by providing longitudinally aligned segments in the tracks 802 and/or 804, etc. A more detailed explanation of example structures for providing this movability functionality and securing mechanisms for the movable strap connection structures is provided below.

Figure 9:
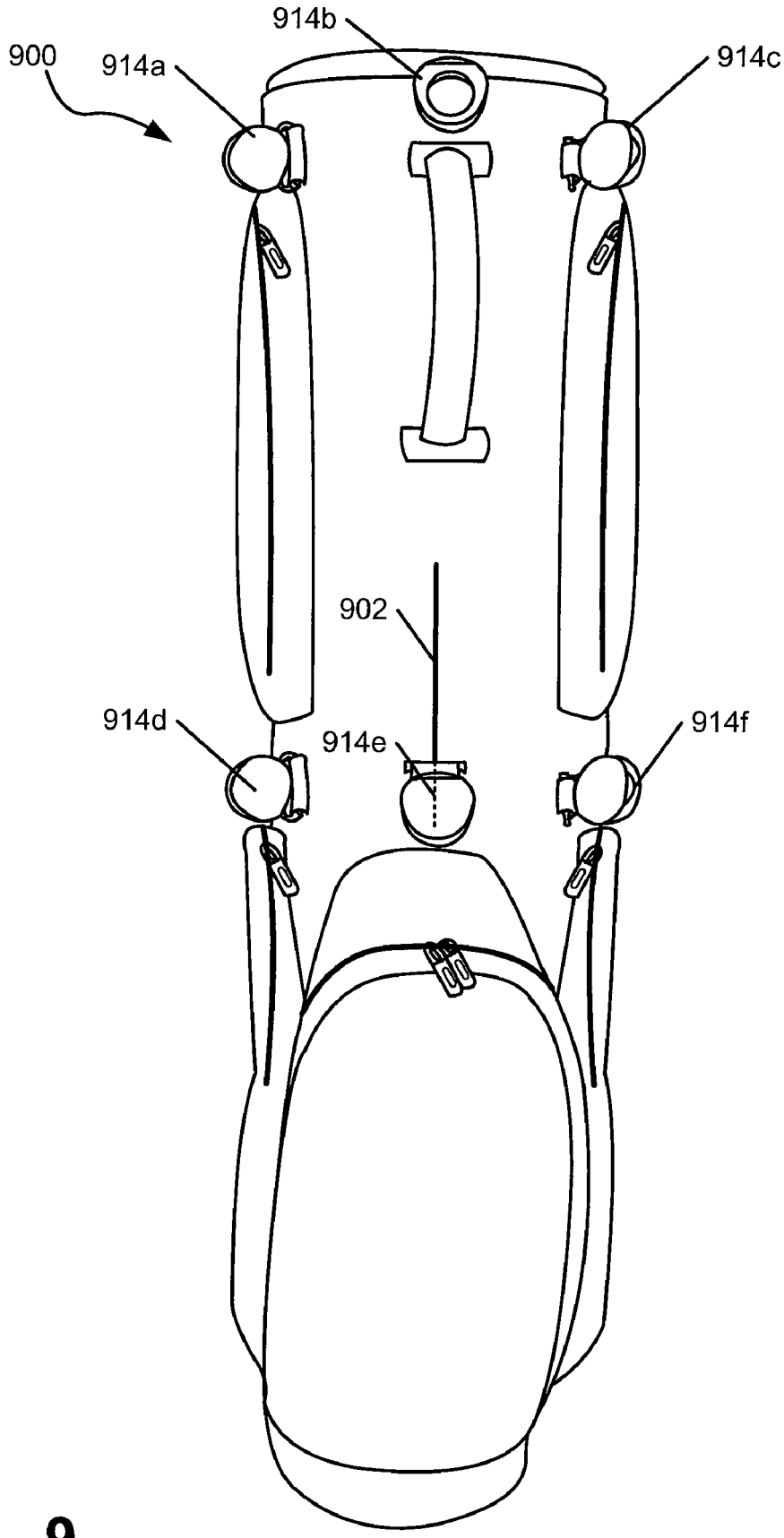

FIG. 9 illustrates still additional features that may be included in golf bag 900 and strapping systems (e.g., strapping system 200) in accordance with at least some examples of this invention. This example bag structure 900 is similar in structure to that shown in FIG. 1 in that six strap connection structures 914*a* through 914*f* are shown, three proximate the top and three longitudinally downward from the top. In this example bag structure 900, however, at least one of the strap connection structures (e.g., connection structure 914*e* in the illustrated example) is movable with respect to the longitudinal direction of the bag structure 900, e.g., along track 902. In this manner, the location of the movable strap connection structure(s) may be determined by the user, in either the single or double strap configurations, to best suit the user's personal tastes or comfort. In this illustrated example, track 902 is provided to allow for longitudinal adjustment of the position of strap connection structure 914*e*, predominantly for providing adjustability and comfort for use in the single strap configuration.

Any of the strap connection structures 914*a* through 914*f* on the bag 900 may be adjustable in this longitudinal manner without departing from this invention, including all of the strap connection structures, any one individual strap connection structure, or any combination of the strap connection structures. Also, this longitudinal adjustability feature also can be provided on any of the other bag structures 600, 700, and/or 800 described above (and any of the additional structures described below). The strap connection structures also may be designed to be movable in at least partially in the circumferential direction, e.g., by making the track 902 angle around the bag circumference, by providing circumferentially oriented segments in the track 902, etc. Optionally, if desired, multiple strap connection structures may be provided within a single track 902.

If desired, aspects of this invention may be practiced with golf bag structures having four strap connection structures, e.g., two proximate the top of the bag and two longitudinally downward from the top (e.g., in the positions of the strap connection structures used in the double strap configurations described above). In such arrangements, the movability, adjustability, and track features described above in conjunction with FIGS. 8 and 9 can be particularly advantageous to allow for more comfortable and better load bearing placement of the strap connection structures.

Figures 10A, 10B, 10C, 10D, 10E:
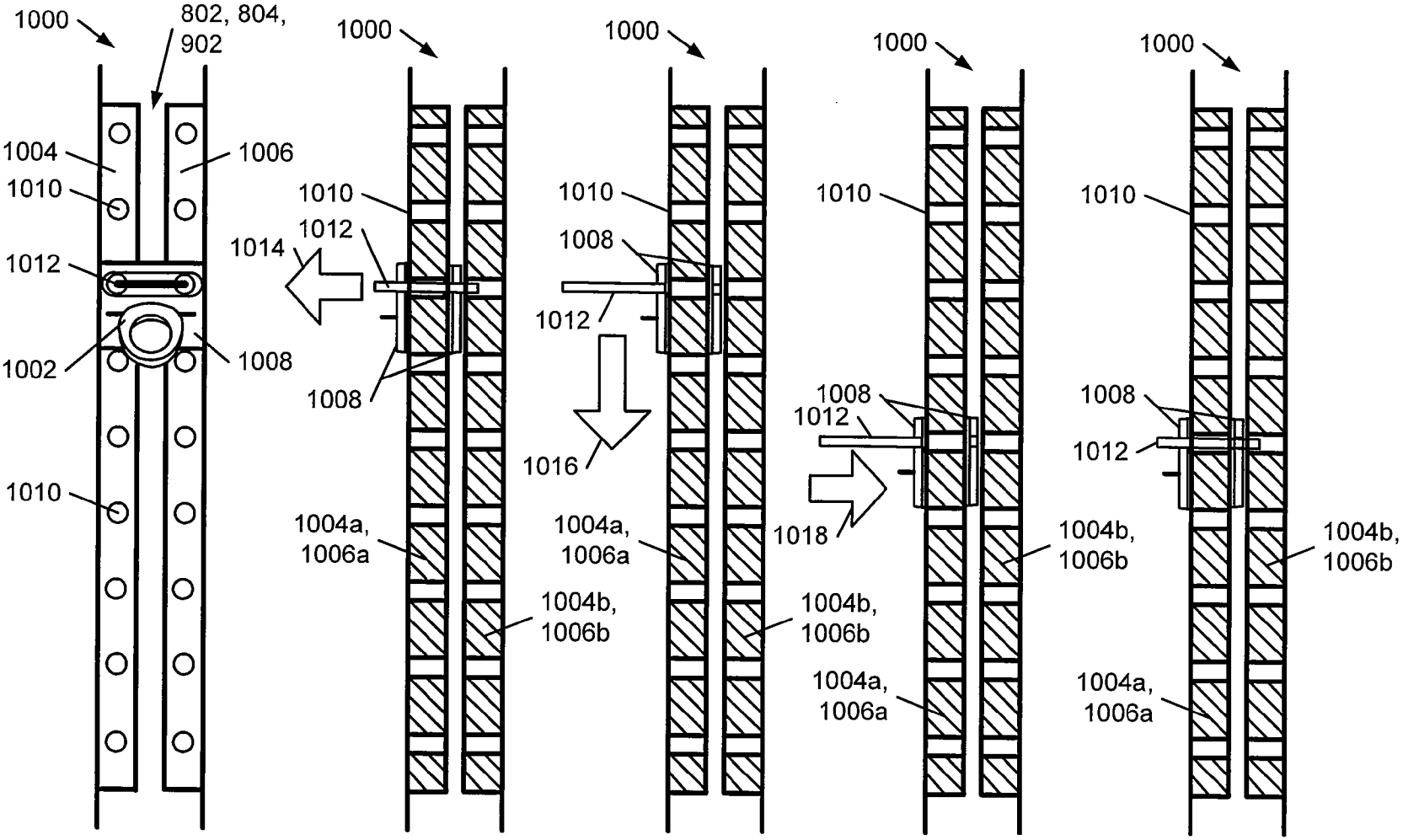

FIGS. 10A through 10E illustrate an example movable securing system 1000 for strap connection structures 1002 of the types described above in conjunction with FIGS. 8 and 9. FIG. 10A illustrates a top view and FIGS. 10B through 10E illustrate cross sectional views of this example system to help illustrate movement and securing of the connection structure. In this example securing system 1000, a track (e.g., tracks 802, 804, and 902 described above) is defined between two rigid members 1004 and 1006, e.g., made from plastic, metal materials, etc. The strap connection structure 1002 is mounted to a base member 1008 that extends between and is retained between the rigid members 1004 and 1006. The base member 1008 may be made from one or multiple pieces, including as an integral piece with the strap connection structure 1002, without departing from this invention. The strap connection structure 1002 may be mounted to the base member 1008 so that it can be pivoted, rotated, etc. The rigid members 1004 and 1006 may include top portions 1004*a* and 1006*a* and bottom portions 1004*b* and 1006*b*, as shown in FIGS. 10B-10E, and a portion of the base member 1008 may extend between these top and bottom portions. Alternatively, if desired, a portion of the body member of the bag structure may function as the bottom portions 1004*b* and 1006*b*. The rigid members 1004 and 1006 may be at least partially recessed into the bag structure, if desired.

The rigid member(s) 1004 and 1006 may include multiple mounting locations 1010 at which the base member 1008 may be mounted. In this example structure 1000, the base member 1008 is fixed in place by a retaining pin structure 1012 that extends through the base member 1008 and through the top portions 1004*a* and 1006*a* and into bottom portions 1004*b* and 1006*b* of the rigid members 1004 and 1006. While FIGS. 10A through 10E show the pin structure 1012 engaging two mounting location holes 1010 (one in each rigid member 1004 and 1006), more mounting location holes 1010 could be engaged without departing from this invention, e.g., such as four (two on one side of the strap connection structure and two on the other side).

FIGS. 10B through 10E illustrate example steps involved in moving this example securing system 1000 and strap connection structure 1002 (for better clarity, while the base member 1008 is shown in these figures, the strap connection structure 1002 (which mounts to the base member 1008) is omitted). As shown in FIG. 10B, when secured at one location, the pin structure 1012 extends through the top of the base member 1008, through the top portions 1004*a* and 1006*a* of the rigid members 1004 and 1006, through the bottom of the base member 1008, and into the bottom portions 1004*b* and 1006*b* of the rigid members 1004 and 1006. The pin structure 1012 may be secured with respect to the other structures in any desired manner without departing from this invention, for example, by threaded connections, by spring loading (e.g., to bias the pin structure 1012 in the downward position, as shown in FIG. 10B), by a nut and bolt type arrangement, etc.

To move the base member 1008 and its attached strap connection structure 1002, first the pin structure 1012 is disengaged from the top portions 1004*a* and 1006*a* and bottom portions 1004*b* and 1006*b* of the rigid members 1004 and 1006 (e.g., by unscrewing individual pin members, by pulling the pin structure 1012 against a spring or other biasing force, by loosening a nut or bolt, etc.) and pulled outward, as shown by arrow 1014 and by a comparison of FIGS. 10B and 10C. Once the pin structure 1012 is disengaged as shown in FIG. 10C, the base member 1008 may be slid along the track 802, 804, and/or 902 to another connection location 1010, as shown by arrow 1016 and by a comparison of FIGS. 10C and 10D. Once at the desired location 1010, the pin structure can be reinserted to secure the base member 1008 to the rigid members 1004 and 1006, as shown by arrow 1018 and by a comparison of FIGS. 10D and 10E.

Figures 11A, 11B:
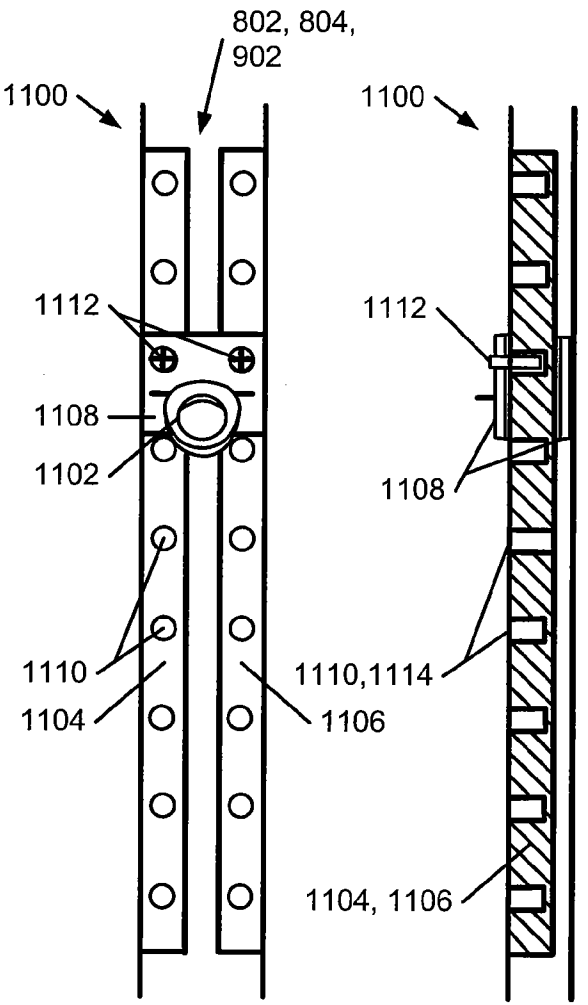

FIGS. 11A and 11B illustrate another example movable securing system 1100 for strap connection structures 1102 of the types described above in conjunction with FIGS. 8 and 9. FIG. 11A illustrates a top view and FIG. 11B illustrates a cross sectional view of the system 1100 to help illustrate movement and securing of the connection structure 1102. In this example securing system 1100, a track (e.g., tracks 802, 804, and 902 described above) is defined between two rigid members 1104 and 1106, e.g., made from plastic, metal materials, etc. The strap connection structure 1102 is mounted to a base member 1108 that extends between and is retained between the rigid members 1104 and 1106. The base member 1108 may be made from one or multiple pieces, including as an integral piece with the strap connection structure 1102, without departing from this invention. The strap connection structure 1102 may be mounted to the base member 1108 so that it can be pivoted, rotated, etc. While the rigid members 1104 and 1106 may include top and bottom portions like those described above in conjunction with FIGS. 10A-10E, in this illustrated example, the rigid members 1104 and 1106 (which may constitute a single piece or multiple pieces) are structured and arranged such that a portion of the base member 1108 extends between the rigid members 1104, 1106 and the body member of the bag structure. If desired, the rigid members 1104 and 1106 may be recessed into a groove provided in the bag structure.

The rigid member(s) 1104 and 1106 may include multiple mounting locations 1110 at which the base member 1108 may be mounted and secured. In this example structure 1100, the base member 1108 is fixed in place by a pair of threaded members, such as screws or bolts 1112, that extend through the base member 1108 and into the threaded openings 1114 provided in the rigid members 1104 and 1106. While FIGS. 11A and 11B show two screws or bolts 1112 engaging two mounting location holes 1110 (one in each of the rigid members 1104 and 1106), more mounting location holes 1110 could be engaged without departing from this invention, e.g., such as four (two on one side of the strap connection structure and two on the other side). Other ways of engaging the base member 1108 with the rigid members 1104 and 1106 may be used without departing from the invention, such as spring biased extendable retaining elements, clamping structures, and the like. The base member 1108 can be moved to different mounting location holes by loosening or removing the screws, bolts 1112, or other securing structure and repositioning the base member, e.g., as generally described above in conjunction with FIGS. 10B through 10E.

Figures 12A, 12B:
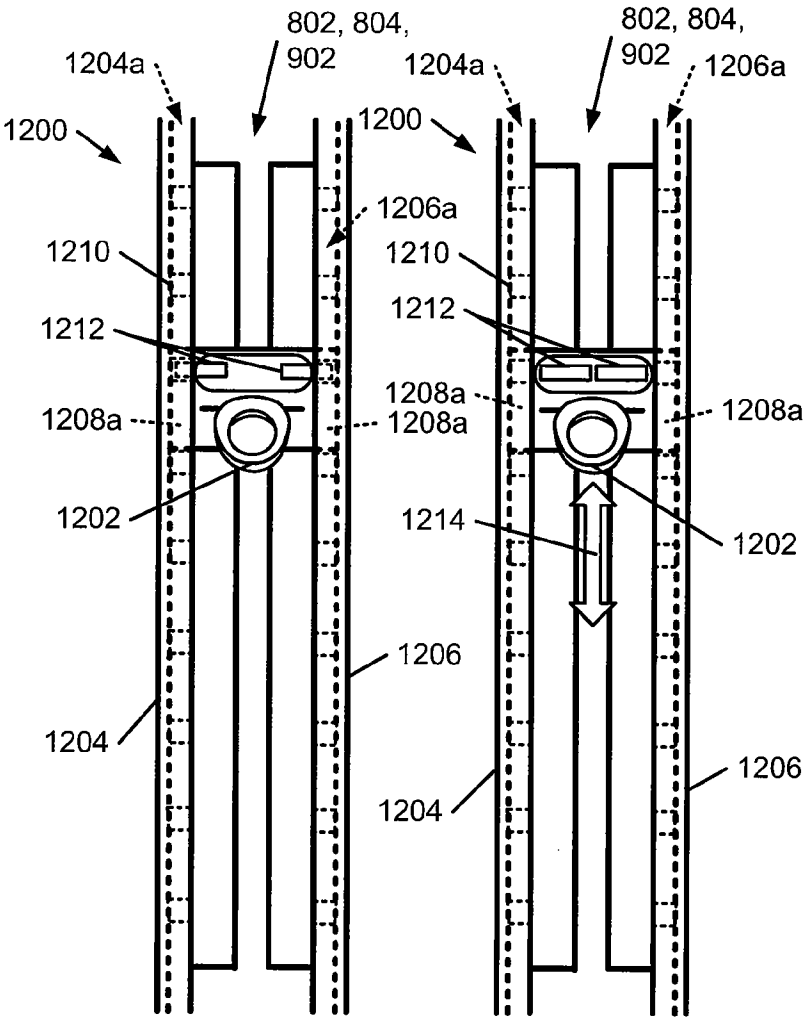

FIGS. 12A and 12B illustrate another example movable securing system 1200 for strap connection structures 1202 of the types described above in conjunction with FIGS. 8 and 9. In this example securing system 1200, a track (e.g., tracks 802, 804, and 902 described above) is defined between two rigid members 1204 and 1206, e.g., made from plastic, metal materials, etc. The track may be formed as a single part or as a multipart structure. The strap connection structure 1202 is mounted to a base member 1208 that extends between and is retained between the rigid members 1204 and 1206. The base member 1208 may be made from one or multiple pieces, including as an integral piece with the strap connection structure 1202, without departing from this invention. The strap connection structure 1202 may be mounted to the base member 1208 so that it can be pivoted, rotated, etc. These example rigid members 1204 and 1206 include side facing grooves 1204*a* and 1206*a* (shown in broken lines in FIGS. 12A and 12B). The grooves 1204*a* and 1206*a* in the rigid members 1204 and 1206 (which may constitute a single piece or multiple pieces) are structured and arranged such that portions of the side edges 1208*a* of the base member 1208 extend into and ride along the grooves 1204*a* and 1206*a*.

The rigid member(s) 1204 and 1206 may include multiple mounting locations 1210 at which the base member 1208 may be mounted and secured. In this example structure 1200, the base member 1208 is fixed in place by a pair of spring loaded retaining elements 1212 that extend from the sides of the base member 1208 and into the mounting location holes 1210 provided in the rigid members 1204 and 1206. While FIGS. 12A and 12B show two spring loaded retaining elements 1212 engaging two mounting location holes 1210 (one in each rigid member 1204 and 1206), more mounting location holes 1210 could be engaged without departing from this invention, e.g., such as four (two on one side of the strap connection structure and two on the other side). Other ways of engaging the base member 1208 with the rigid members 1204 and 1206 may be used without departing from the invention, such as threaded connectors, clamping structures, and the like.

The base member 1208 can be moved to different mounting locations 1210 by drawing the spring loaded retaining pins 1212 out of their mounting hole locations 1210 (as shown by a comparison of FIGS. 12A and 12B) and repositioning the base member 1208 by moving it along the track 802, 804, and/or 902, e.g., as generally shown by arrow 1214 in FIG. 12B.

While FIGS. 10A through 12B illustrate various straight elements for creating the tracks 802, 804, and/or 902 (e.g., to facilitate the longitudinal movement of the connection structures), if desired, the same or similar structures could be constructed in a curved manner so as to better facilitate circumferential movement of the connection structures (assuming that the area of the bag body member where the connection structures are mounted are rounded or curved). As another example, if desired, the location(s) of the tracks may correspond to a rectangular, square, or other straight circumferential area, allowing the use of straight tracks in the circumferential direction as well.

III. Conclusion

While the invention has been described with respect to specific examples including presently preferred modes of carrying out the invention, those skilled in the art will appreciate that there are numerous variations and permutations of the above described systems and techniques may be made without departing from this invention. For example, if desired, different types of strap connectors and strap connection structures may be used without departing from this invention, including conventional releasable connectors and connection structures that are known and used in the art, such as clamps, clevis type connectors, hooks with spring biased closures, etc. Additionally, aspects of this invention may be utilized with other devices carried by shoulder-borne strapping systems, such as backpacks, luggage, briefcases, purses, etc. Other substitutions and/or modifications may be made to any of the various structures and/or arrangements described above without departing from this invention.

What is claimed is:

1. A golf bag, comprising:

a body member constructed from one or more parts and including an open first end for receiving one or more golf clubs and a closed second end, wherein the body member extends in a longitudinal direction from the first end to the second end, and wherein the body member defines an overall height dimension extending in the longitudinal direction;

at least five strap connection structures engaged with the body member, each strap connection structure for releasably engaging a strap connector, wherein the strap connection structures include:

a first strap connection structure located proximate the first end, a second strap connection structure located proximate the first end and circumferentially displaced from the first strap connection structure, a third strap connection structure located proximate the first end and circumferentially displaced from the first and second strap connection structures such that the second strap connection structure is located between the first and third strap connection structures with respect to a circumferential direction around the body member, a fourth strap connection structure located between the first end and the second end of the body member at a distance of at least 40% of the overall height dimension away from the first end, and a fifth strap connection structure located between the first end and the second end of the body member at a distance of at least 40% of the overall height dimension away from the first end, wherein the fifth strap connection structure is circumferentially displaced from the fourth strap connection structure; and a strap system including a first strap member and a second strap member for releasably engaging the body member at a plurality of the strap connection structures, wherein the strap system is convertible between a double strap configuration and a single strap configuration, wherein when in the double strap configuration, the strap system is engaged with the body member as follows:

a first strap connector of the first strap member releasably engages the first strap connection structure, a second strap connector of the first strap member releasably engages the third strap connection structure, a third strap connector of the first strap member releasably engages the fourth strap connection structure, a first strap connector of the second strap member releasably engages the fifth strap connection structure, and a second strap connector of the second strap member releasably engages a base portion of the first strap member, and wherein when in the single strap configuration, the strap system is engaged with the body member as follows:

the first strap connector of the second strap member releasably engages the fifth strap connection structure, the second strap connector of the second strap member releasably engages the second strap connection structure, and the first strap member is not engaged with any of the first through fifth strap connection structures.

2. A golf bag according to claim 1, wherein the fifth strap connection structure is movable with respect to the body member.

3. A golf bag according to claim 2, wherein the fifth strap connection structure is movable in the circumferential direction around the body member.

4. A golf bag according to claim 2, wherein the fifth strap connection structure is movable in the longitudinal direction.

5. A golf bag, comprising:

a body member constructed from one or more parts and including an open first end for receiving one or more golf clubs and a closed second end, wherein the body member extends in a longitudinal direction from the first end to the second end, and wherein the body member defines an overall height dimension extending in the longitudinal direction;

at least five strap connection structures engaged with the body member, each strap connection structure for releasably engaging a strap connector, wherein the strap connection structures include:

a first strap connection structure located proximate the first end, a second strap connection structure located proximate the first end and circumferentially displaced from the first strap connection structure, a third strap connection structure located proximate the first end and circumferentially displaced from the first and second strap connection structures such that the second strap connection structure is located between the first and third strap connection structures with respect to a circumferential direction around the body member, a fourth strap connection structure located between the first end and the second end of the body member at a distance of at least 40% of the overall height dimension away from the first end, and a fifth strap connection structure located between the first end and the second end of the body member at a distance of at least 40% of the overall height dimension away from the first end, wherein the fifth strap connection structure is circumferentially displaced from the fourth strap connection structure; and a strap system including a first strap member and a second strap member for releasably engaging the body member at a plurality of the strap connection structures, wherein the strap system is convertible between a double strap configuration and a single strap configuration, wherein when in the double strap configuration, the strap system is engaged with the body member as follows:

a first strap connector of the first strap member releasably engages the first strap connection structure, a second strap connector of the first strap member releasably engages the fourth strap connection structure, a third strap connector of the first strap member releasably engages the fifth strap connection structure, a first strap connector of the second strap member releasably engages the third strap connection structure, and a second strap connector of the second strap member releasably engages a base portion of the first strap member, and wherein when in the single strap configuration, the strap system is engaged with the body member as follows:

the first strap connector of the second strap member releasably engages the fourth strap connection structure, the second strap connector of the second strap member releasably engages the second strap connection structure, and the first strap member is not engaged with any of the first through fifth strap connection structures.

6. A golf bag according to claim 5, wherein the fourth strap connection structure is movable with respect to the body member.

7. A golf bag according to claim 6, wherein the fourth strap connection structure is movable in the circumferential direction around the body member.

8. A golf bag according to claim 6, wherein the fourth strap connection structure is movable in the longitudinal direction.

9. A golf bag, comprising:

a body member constructed from one or more parts and including an open first end for receiving one or more golf clubs and a closed second end, wherein the body member extends in a longitudinal direction from the first end to the second end, and wherein the body member defines an overall height dimension extending in the longitudinal direction;

at least six strap connection structures engaged with the body member, each strap connection structure for releasably engaging a strap connector, wherein the strap connection structures include:

a first strap connection structure located proximate the first end, a second strap connection structure located proximate the first end and circumferentially displaced from the first strap connection structure, a third strap connection structure located proximate the first end and circumferentially displaced from the first and second strap connection structures such that the second strap connection structure is located between the first and third strap connection structures with respect to a circumferential direction around the body member, a fourth strap connection structure located between the first end and the second end of the body member at a distance of at least 40% of the overall height dimension away from the first end, a fifth strap connection structure located between the first end and the second end of the body member at a distance of at least 40% of the overall height dimension away from the first end, wherein the fifth strap connection structure is circumferentially displaced from the fourth strap connection structure, and a sixth strap connection structure located between the first end and the second end of the body member at a distance of at least 40% of the overall height dimension away from the first end, wherein the sixth strap connection structure is circumferentially displaced from the fourth and fifth strap connection structures such that the fifth strap connection structure is located between the fourth and sixth strap connection structures with respect to the circumferential direction; and a strap system including a first strap member and a second strap member for releasably engaging the body member at a plurality of the strap connection structures, wherein the strap system is convertible between a double strap configuration in which both the first and second strap members extend over a user's shoulders and support the body member and a single strap configuration in which only the second strap member supports the body member, wherein when in the double strap configuration, the strap system is engaged with the body member as follows:

a first strap connector of the first strap member releasably engages the first strap connection structure, a second strap connector of the first strap member releasably engages the third strap connection structure, a third strap connector of the first strap member releasably engages the fourth strap connection structure, a first strap connector of the second strap member releasably engages the sixth strap connection structure, and a second strap connector of the second strap member releasably engages a base portion of the first strap member, and wherein when in the single strap configuration, the strap system is engaged with the body member as follows:

the first strap connector of the second strap member releasably engages the fifth strap connection structure, the second strap connector of the second strap member releasably engages the second strap connection structure, and the first strap member is not engaged with any of the first through sixth strap connection structures.

10. A golf bag according to claim 9, wherein the base portion of the first strap member is located so as to contact a user's back when the strap system is in the double strap configuration.

11. A golf bag according to claim 10, wherein the base portion of the first strap member includes padding.

12. A golf bag according to claim 9, wherein the base portion of the first strap member includes:

a first free end at which the first strap connector is provided, a second free end at which the second strap connector is provided, and a third free end at which the third strap connector is provided.

13. A golf bag according to claim 9, wherein the base portion of the first strap member includes a connector for releasably engaging the second strap connector of the second strap member.

14. A golf bag according to claim 13, wherein the connector for releasably engaging the second strap connector is located at a central hub area of the base portion of the first strap member.

15. A golf bag according to claim 13, wherein the connector for releasably engaging the second strap connector provides a pivotal connection between the base portion of the first strap member and the second strap member.

16. A golf bag according to claim 9, wherein the first, second, and third strap connectors of the first strap member and the first and second strap connectors of the second strap member include coding that provides information for properly engaging the strap connectors with the first, second, third, fourth, fifth, and sixth strap connection structures of the body member in the double strap and single strap configurations.

17. A golf bag according to claim 9, wherein the first, second, third, fourth, fifth, and sixth strap connection structures of the body member include coding that provides information for properly engaging the strap connection structures with the first and second strap members in the double strap and single strap configurations.

18. A golf bag, comprising:

a body member constructed from one or more parts and including an open first end for receiving one or more golf clubs and a closed second end, wherein the body member extends in a longitudinal direction from the first end to the second end, and wherein the body member defines an overall height dimension extending in the longitudinal direction;

at least six strap connection structures engaged with the body member, each strap connection structure for releasably engaging a strap connector, wherein the strap connection structures include:

a first strap connection structure located proximate the first end, a second strap connection structure located proximate the first end and circumferentially displaced from the first strap connection structure, a third strap connection structure located proximate the first end and circumferentially displaced from the first and second strap connection structures such that the second strap connection structure is located between the first and third strap connection structures with respect to a circumferential direction around the body member, a fourth strap connection structure located between the first end and the second end of the body member at a distance of at least 40% of the overall height dimension away from the first end, a fifth strap connection structure located between the first end and the second end of the body member at a distance of at least 40% of the overall height dimension away from the first end, wherein the fifth strap connection structure is circumferentially displaced from the fourth strap connection structure, and a sixth strap connection structure located between the first end and the second end of the body member at a distance of at least 40% of the overall height dimension away from the first end, wherein the sixth strap connection structure is circumferentially displaced from the fourth and fifth strap connection structures such that the fifth strap connection structure is located between the fourth and sixth strap connection structures with respect to the circumferential direction; and a strap system including a first strap member and a second strap member for releasably engaging the body member at a plurality of the strap connection structures, wherein the strap system is convertible between a double strap configuration in which both the first and second strap members extend over a user's shoulders and support the body member and a single strap configuration in which only the second strap member supports the body member, wherein when in the double strap configuration, the strap system is engaged with the body member as follows:

a first strap connector of the first strap member releasably engages the first strap connection structure, a second strap connector of the first strap member releasably engages the fourth strap connection structure, a third strap connector of the first strap member releasably engages the sixth strap connection structure, a first strap connector of the second strap member releasably engages the third strap connection structure, and a second strap connector of the second strap member releasably engages a base portion of the first strap member, and wherein when in the single strap configuration, the strap system is engaged with the body member as follows:

the first strap connector of the second strap member releasably engages the fifth strap connection structure, the second strap connector of the second strap member releasably engages the second strap connection structure, and the first strap member is not engaged with any of the first through sixth strap connection structures.

19. A golf bag according to claim 18, wherein the base portion of the first strap member is located so as to contact a user's back when the strap system is in the double strap configuration.

20. A golf bag according to claim 19, wherein the base portion of the first strap member includes padding.

21. A golf bag according to claim 18, wherein the base portion of the first strap member includes:

a first free end at which the first strap connector is provided, a second free end at which the second strap connector is provided, and a third free end at which the third strap connector is provided.

22. A golf bag according to claim 18, wherein the base portion of the first strap member includes a connector for releasably engaging the second strap connector of the second strap member.

23. A golf bag according to claim 22, wherein the connector for releasably engaging the second strap connector is located at a central hub area of the base portion of the first strap member.

24. A golf bag according to claim 22, wherein the connector for releasably engaging the second strap connector provides a pivotal connection between the base portion of the first strap member and the second strap member.

25. A golf bag according to claim 18, wherein the first, second, and third strap connectors of the first strap member and the first and second strap connectors of the second strap member include coding that provides information for properly engaging the strap connectors with the first, second, third, fourth, fifth, and sixth strap connection structures of the body member in the double strap and single strap configurations.

26. A golf bag according to claim 18, wherein the first, second, third, fourth, fifth, and sixth strap connection structures of the body member include coding that provides information for properly engaging the strap connection structures with the first and second strap members in the double strap and single strap configurations.

* * * * *